US010132505B2

(12) United States Patent
Son et al.

(10) Patent No.: US 10,132,505 B2
(45) Date of Patent: Nov. 20, 2018

(54) COOKING APPLIANCE AND METHOD OF CONTROLLING THE SAME

(71) Applicant: SAMSUNG ELECTRONICS CO., LTD., Suwon-si, Gyeonggi-do (KR)

(72) Inventors: Hyung Min Son, Suwon-si (KR); Byung Ik Choi, Seoul (KR); Jun Hoe Choi, Hwaseong-si (KR); Myoung Keun Kwon, Seoul (KR); Ji-Young Lee, Yongin-si (KR); Jeong Su Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 282 days.

(21) Appl. No.: 15/072,993

(22) Filed: Mar. 17, 2016

(65) Prior Publication Data

US 2016/0273778 A1 Sep. 22, 2016

(30) Foreign Application Priority Data

Mar. 17, 2015 (KR) ..... 10-2015-0036721

(51) Int. Cl.
*F24C 15/20* (2006.01)
*F24C 15/32* (2006.01)

(52) U.S. Cl.
CPC ..... *F24C 15/2007* (2013.01); *F24C 15/2021* (2013.01); *F24C 15/322* (2013.01)

(58) Field of Classification Search
CPC . F24C 15/2007; F24C 15/2021; F24C 15/322
USPC ..... 126/21 A
See application file for complete search history.

(56) References Cited

U.S. PATENT DOCUMENTS

| | | | |
|---|---|---|---|
| 2005/0077288 | A1 | 4/2005 | Gerl |
| 2008/0149088 | A1 | 6/2008 | Inada et al. |
| 2010/0064902 | A1 | 3/2010 | Sakane et al. |
| 2015/0059595 | A1 | 3/2015 | Rand et al. |

FOREIGN PATENT DOCUMENTS

| | | |
|---|---|---|
| EP | 1 975 516 A1 | 10/2008 |
| JP | 2010-38368 | 2/2010 |
| JP | 2010-38374 | 2/2010 |
| JP | 2012-37486 | 2/2012 |
| KR | 1993-0000892 | 1/1993 |
| KR | 2003-0018408 | 3/2003 |
| KR | 10-2005-0026737 | 3/2005 |
| KR | 10-2005-0081309 | 8/2005 |
| KR | 10-0623868 | 9/2006 |

(Continued)

OTHER PUBLICATIONS

Extended European search report dated Dec. 9, 2016 in related European Patent Application No. 16160628.0.

(Continued)

*Primary Examiner* — Gregory Huson
*Assistant Examiner* — Daniel E Namay
(74) *Attorney, Agent, or Firm* — Staas & Halsey LLP

(57) ABSTRACT

A cooking appliance includes a cooking chamber in which food is accommodated, a machine room separated from the cooking chamber, an exhaust assembly configured to discharge fluids inside the machine room to the outside, and a sensor assembly provided in the machine room and configured to measure the amount of steam of fluids which flow from the cooking chamber to the machine room by driving of the exhaust assembly.

19 Claims, 24 Drawing Sheets

(56) References Cited

FOREIGN PATENT DOCUMENTS

| | | | |
|---|---|---|---|
| WO | 2004/098292 | A2 | 11/2004 |
| WO | 2004/098292 | A3 | 11/2004 |

OTHER PUBLICATIONS

Partial European Search Report dated Aug. 19, 2016 in corresponding European Patent Application No. 16160628.0.
European Office Action dated Jun. 12, 2017 in corresponding European Patent Application No. 16160628.0.

COOKING APPLIANCE AND METHOD OF CONTROLLING THE SAME

CROSS-REFERENCE TO RELATED APPLICATION

This application claims the priority benefit of Korean Patent Application No. 10-2015-0036721, filed on Mar. 17, 2015 in the Korean Intellectual Property Office, the disclosure of which is incorporated herein by reference.

BACKGROUND

1. Field

Embodiments of the present disclosure relate to a cooking appliance and a method of controlling the same, and more particularly, a cooking appliance including a gas sensor and a method of controlling the same.

2. Description of the Related Art

A cooking appliance is an apparatus which cooks food by heating the food accommodated in a cooking chamber.

Such a cooking appliance can be classified as a gas oven which heats food by burning a gas, an electric oven which heats food by converting electric energy into thermal energy, an electronic range which heats food by emitting microwaves onto the food, a gas range which heats a container in which food is put by burning a gas, and an induction range which heats a container in which food is put by generating a magnetic field, etc.

In order for the cooking appliance to perform an automatic cooking process, there is a need for determining a cooking state of food.

SUMMARY

Therefore, it is an aspect of the present disclosure to provide a cooking appliance capable of precisely measuring the amount of steam inside a cooking chamber and automatically cooking according to the measured amount of steam, and a method of controlling the same.

Additional aspects of the disclosure will be set forth in part in the description which follows and, in part, will be obvious from the description, or may be learned by practice of the disclosure.

In accordance with one aspect of the present disclosure, a cooking appliance includes a cooking chamber in which food is accommodated; a machine room separated from the cooking chamber; an exhaust assembly configured to discharge fluids inside the machine room to the outside; and a sensor assembly provided in the machine room and configured to measure the amount of steam of fluids which flow from the cooking chamber to the machine room by driving of the exhaust assembly.

The sensor assembly may include a transfer unit in communication with the cooking chamber so that the fluids inside the cooking chamber flow into the machine room, and a sensor unit provided at the transfer unit and configured to detect an amount of steam of the fluids which flow along the transfer unit.

The sensor assembly may further include an exhaust pipe which guides the fluids introduced into the transfer unit to the exhaust assembly.

The sensor assembly may further include a blocking unit which blocks the fluids inside the cooking chamber from flowing into the machine room.

The blocking unit may include a throttle provided in the transfer unit and configured to block a flow path inside the transfer unit, a valve motor configured to drive the throttle, a cam shaft coupled to the throttle and rotated by the valve motor, and a valve sensor which senses whether the flow path is blocked by a cam knob of the cam shaft The cooking appliance may further include a control unit which determines a completion point of cooking of the food based on a change rate of the amount of steam.

The control unit may calculate the change rate of the amount of steam according to a preset calculation period.

The control unit may determine a cooking progress state of the food based on the change rate of the amount of steam, and determines the completion point of cooking based on the cooking progress state.

The control unit may determine the cooking progress state of the food based on a maximum change rate of the amount of steam and a change rate of the amount of steam at a preset reference time.

The control unit may determine the completion point of cooking of the food within a preset range of guide cooking time based on a type of the food.

The control unit may perform an additional cooking process after the completion point of cooking so that the food is cooked in an input cooking state.

In accordance with another aspect of the present disclosure, a cooking appliance includes a cooking chamber in which food is accommodated; a machine room provided separately from the cooking chamber; an exhaust assembly configured to forcibly discharge fluids inside the machine room to the outside; and a sensor assembly configured to measure an amount of steam of fluids which flow from the cooking chamber to the machine room by the forced discharge of the exhaust assembly; and a control unit configured to determine a completion point of cooking of the food based on a change rate of the amount of steam measured by the sensor assembly.

The sensor assembly may include a transfer pipe in communication with the cooking chamber so that the fluids inside the cooking chamber are introduced into the transfer pipe, an exhaust pipe connected to the transfer pipe so that the fluids introduced into the transfer pipe are guided to the exhaust assembly, and a steam sensor configured to protrude in an inward direction of the transfer pipe to measure the amount of steam of the fluids which flow in the transfer pipe.

The sensor assembly may further include an inlet through which the fluids inside the cooking chamber are introduced, and an outlet through which the introduced fluids are discharged, wherein the outlet may be provided to have a size smaller than a size of the inlet.

The exhaust assembly may include an exhaust duct configured to guide air inside the machine room to the outside of the cooking appliance, and an exhaust fan configured to forcibly flow the air inside the machine room into the exhaust duct, wherein the exhaust pipe may guide the fluids discharged from the outlet toward the exhaust fan.

The sensor assembly may further include a throttle provided in the transfer pipe and configured to block the fluids from being introduced into the cooking chamber, and a valve motor configured to drive the throttle, wherein the control unit may determine whether the fluids being introduced are blocked based on whether an automatic cooking of the cooking chamber is performed.

In accordance with another aspect of the present disclosure, a method of controlling the cooking appliance according to the aspect of the present disclosure, which includes calculating a change rate of the amount of steam; and determining a completion point of cooking of food based on the change rate of the amount of steam.

The determining of the completion point of cooking may include determining a cooking progress state of the food based on a maximum change rate of the amount of steam and a change rate of the amount of steam at a reference time, and determining the completion point of cooking within a preset range of cooking guide time based on the cooking progress state.

The method may further include additionally cooking the food according to a user input.

According to the cooking appliance and the method of controlling the same, a variation of the amount of steam inside the cooking chamber may be measured precisely.

Further, according to the cooking appliance and the method of controlling the same, an automatic cook process may be provided by checking a cooking state of food using a variation of the amount of steam.

BRIEF DESCRIPTION OF THE DRAWINGS

These and/or other aspects of the disclosure will become apparent and more readily appreciated from the following description of the embodiments, taken in conjunction with the accompanying drawings of which:

FIGS. 8A to 8B are views for describing an operation of an opening and closing unit of the sensor assembly, in which FIG. 8A is a cross-sectional view of the sensor assembly when a flow path is opened, and FIG. 8B is a cross-sectional view of the sensor assembly when the flow path is closed;

DETAILED DESCRIPTION

Figure 1:
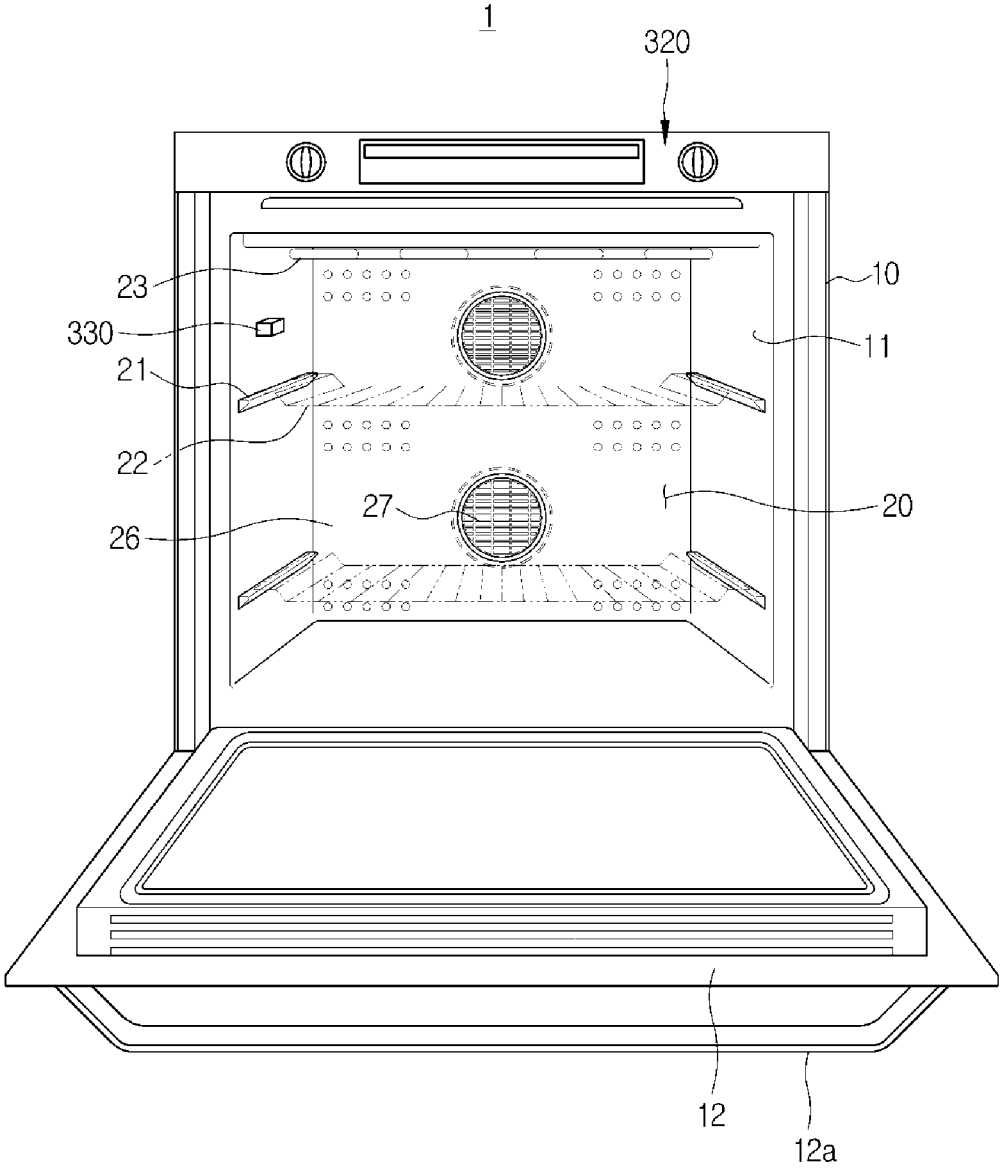
FIG. 1 is a front view of a cooking appliance according to one embodiment.

Reference will now be made in detail to the embodiments of the present disclosure, examples of which are illustrated in the accompanying drawings, wherein like reference numerals refer to like elements throughout.

Hereinafter, the present disclosure will be described with reference to the accompanying drawings in detail.

Figure 2:
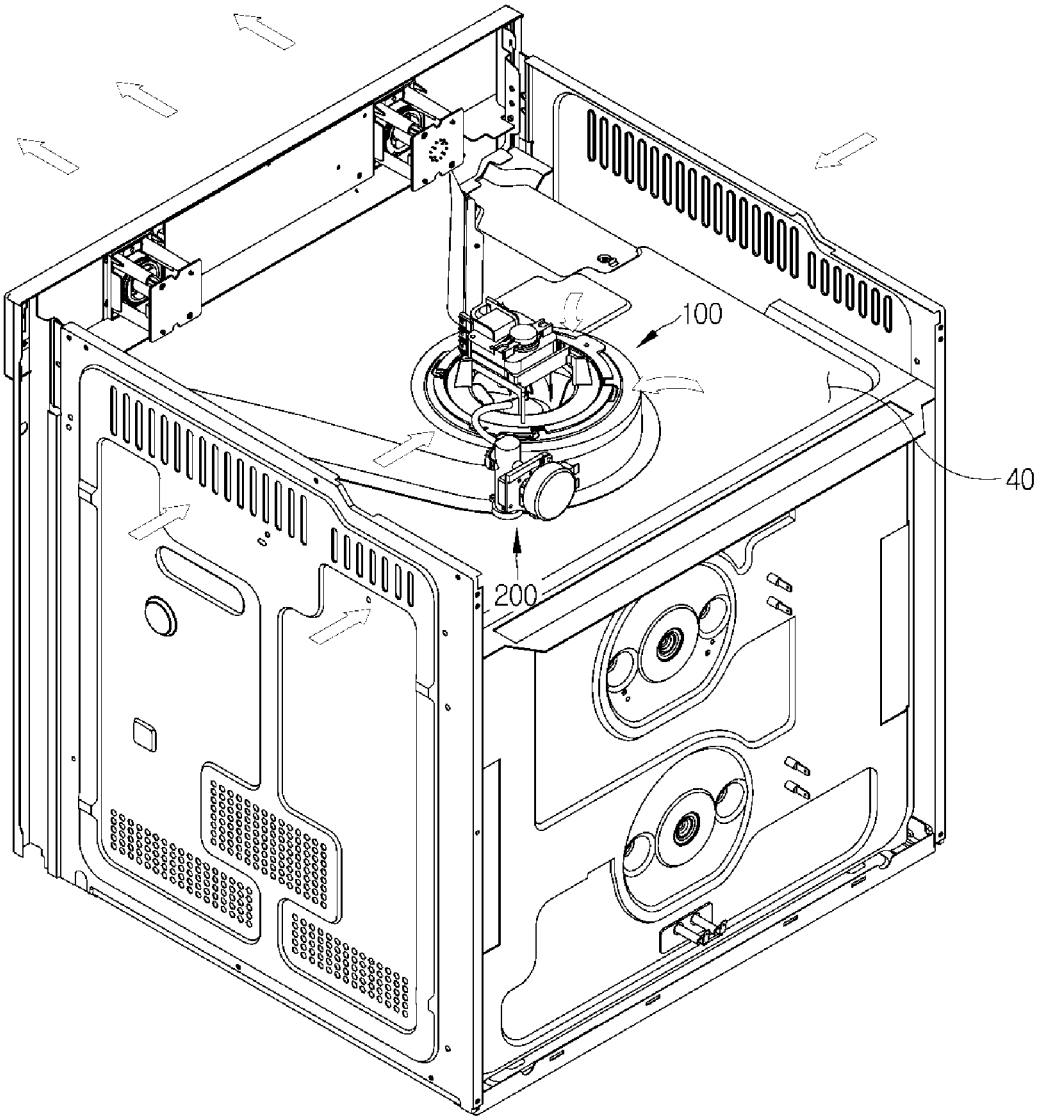
FIG. 2 is a perspective view schematically illustrating a machine room of the cooking appliance according to one embodiment.
Figure 3:
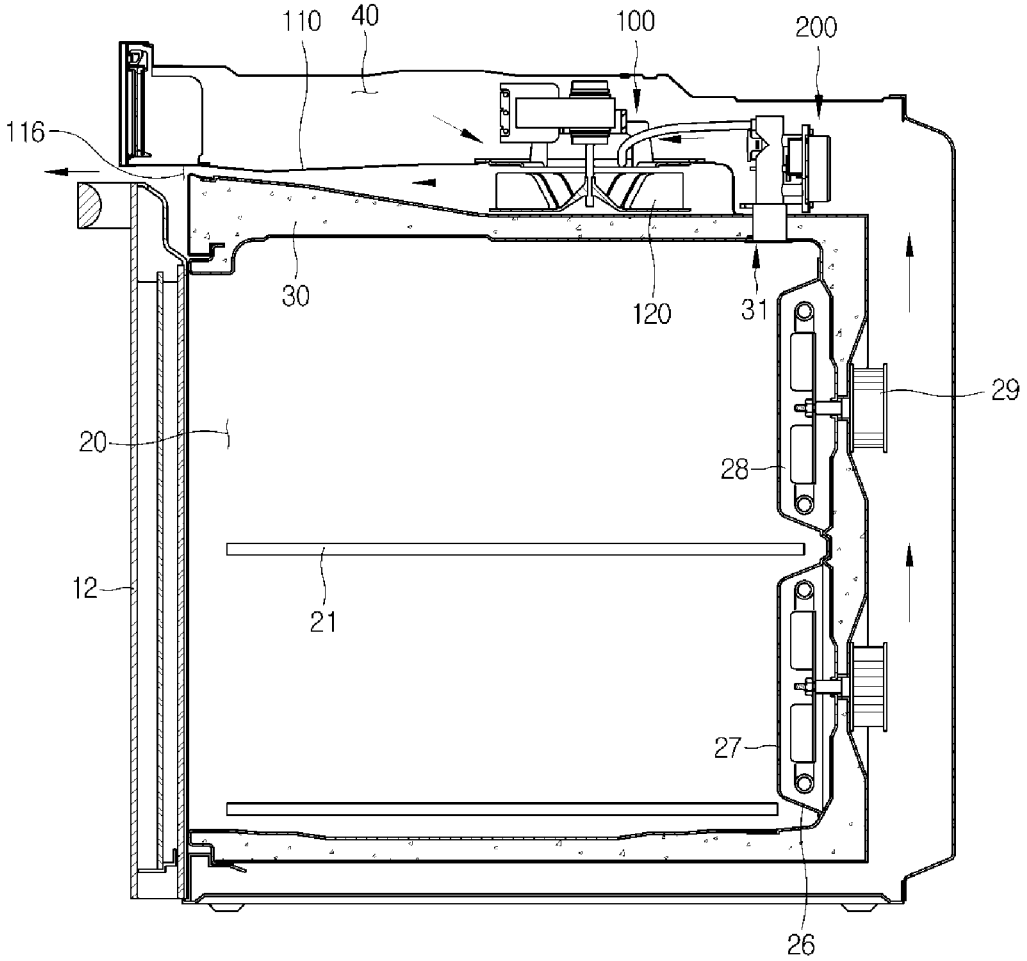
FIG. 3 is a schematic side view of the cooking appliance according to one embodiment.

FIG. 1 is a front view of a cooking appliance according to one embodiment, FIG. 2 is a perspective view schematically illustrating a machine room of the cooking appliance according to one embodiment, and FIG. 3 is a schematic side view of the cooking appliance according to one embodiment.

Referring to FIGS. 1 to 3, a cooking appliance 1 according to one embodiment includes an outer case 10 forming an exterior of the cooking appliance 1 and an inner case 11 provided in the outer case 10 and forming a cooking chamber 20 inside the cooking appliance 1.

The outer case 10 and the inner case 11 may each have a schematic box shape provided with an opening in a front surface thereof, and the outer case 10 and inner case 11 may be opened and closed by a door 12 provided in front thereof.

The door 12 is provided at a front surface of the cooking chamber 20 in a shape corresponding to the opening. The door 12 may be rotatably hinge-coupled to a lower portion of the inner case 11, and may open and close the cooking chamber 20. A handle 12*a* is provided at a front surface of the door 12 so that the door 12 is able to be opened and closed easily.

The cooking chamber 20 provided in the inner case 11 accommodates food.

Guide rails 21 are provided at both sides of the cooking chamber 20. The guide rails 21 may be symmetrically provided at the both sides of the cooking chamber 20. Racks 22 on which food, a container in which the food is put, or the like is put may be detachably coupled to the guide rails 21.

Since the racks 22 are easily withdrawn or inserted along the guide rails 21, a user easily inserts or withdraws food into or from the cooking chamber 20 using the racks 22.

A heat source 23 which generates heat for heating food put on the racks 22 is installed in an upper portion of the cooking chamber 20. As the heat source 23 generates heat using electric power or a gas, a type of the heat source 23 may be determined according to the cooking appliance 1.

A temperature sensor 330 for measuring a temperature of the cooking chamber 20 may be provided at the cooking chamber 20. As shown in FIG. 1, the temperature sensor 330 may be provided at a side surface of the cooking chamber 20, but the location of the temperature sensor 330 is not limited thereto.

Meanwhile, the heat source 23 is provided in the upper portion of the cooking chamber 20 in FIG. 1, the location of the heat source 23 is not limited thereto. Further, the heat source 23 may be omitted according to a type of the cooking appliance 1.

For example, in the case of an electronic range in which the cooking appliance 1 emits microwaves onto food to heat the food, the heat source may be omitted and a microwave generator may be provided in the cooking appliance 1 instead of the heat source.

A circulation fan 28 is provided behind the cooking chamber 20 to flow fluids in the cooking chamber 20. The circulation fan 28 is rotated by a circulation motor 29 coupled to the circulation fan 28. When the circulation fan 28 is rotated, a flow of the fluids is generated by the circulation fan 28. Heat generated from the heat source 23 by the flow of the fluids is uniformly transmitted to the cooking chamber 20 and the food is uniformly cooked.

A fan cover 26 formed of a member in a plate shape is provided in front of the circulation fan 28. A circulation port 27 may be formed in the fan cover 26 to flow the fluids by the circulation fan 28.

Meanwhile, a user interface 320 may be provided at a front surface of the cooking appliance 1. The user interface 320 may receive a control command of the cooking appliance 1 from a user, or may display various types of information on an operation or setting of the cooking appliance 1 to the user.

Further, the cooking appliance 1 may further include a machine room 40. The machine room 40 may be provided between the outer case 10 and the inner case 11.

Various types of electrical units needed for driving the cooking appliance 1 may be provided in the machine room 40. For example, a control circuit board for controlling the user interface 320 and a main circuit board for controlling the heat source and the circulation motor may be provided in the machine room 40.

Such a machine room 40 may be provided above the cooking chamber 20, but the location of the machine room 40 is not limited thereto. For example, the machine room 40 may be provided under the cooking chamber 20, or may be provided behind the cooking chamber 20.

An insulator 30 is provided between the cooking chamber 20 and the machine room 40, and thus a heat leakage of the cooking chamber 20 may be prevented and the electrical units may protected from heat of the cooking chamber 20.

A through hole 31 may be provided between the machine room 40 and the cooking chamber 20 to flow fluids, and a sensor assembly 200 is coupled to the through hole provided between the machine room 40 to communicate with the cooking chamber 20. The sensor assembly 200 will be described in detail below.

Further, the machine room 40 is cooled by an exhaust assembly 100. The electrical units are very weak with respect to heat. The exhaust assembly 100 may be provided in the machine room 40 to cool the machine room 40, and thus the electrical units may be protected.

The exhaust assembly 100 forcibly discharges fluids inside the machine room 40 to the outside of the cooking appliance 1, and thus damage on the electrical units caused by heat may be prevented. Hereinafter, the exhaust assembly 100 will be described in detail.

Figure 4:
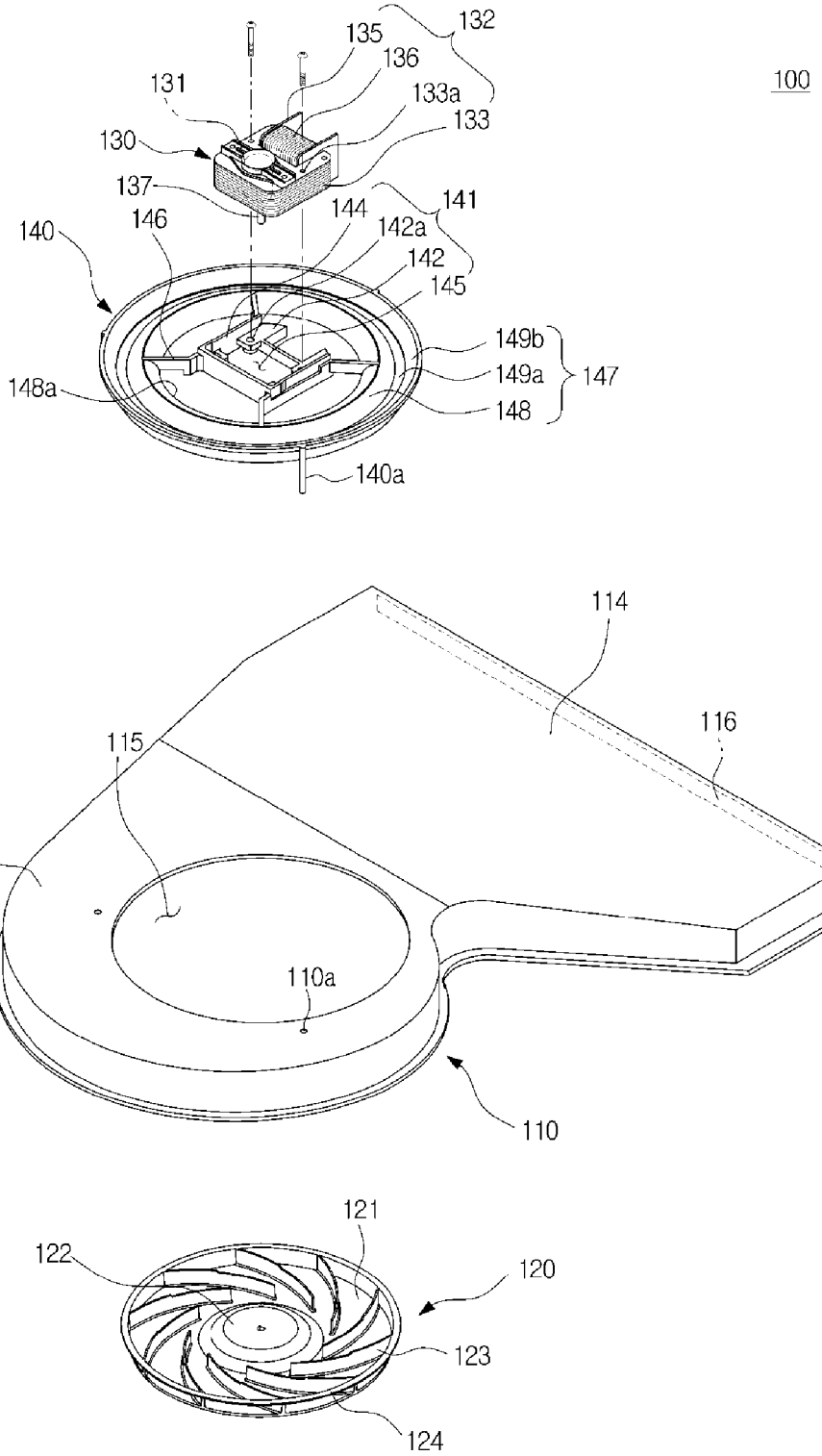
FIG. 4 is an exploded perspective view of an exhaust assembly provided in the cooking appliance according to one embodiment.

FIG. 4 is an exploded perspective view of an exhaust assembly provided in the cooking appliance according to one embodiment.

Referring to FIGS. 2 to 4, the exhaust assembly 100 may be include an exhaust duct 110 which suctions the fluids in the machine room 40 and discharges the fluids to the front of the cooking appliance 1, an exhaust fan 120 which forcibly flows the fluids inside the machine room 40, an exhaust motor 130 for driving the exhaust fan 120, and a support bracket 140 for supporting the exhaust motor 130.

The exhaust duct 110 may be formed in a venturi tube shape in which a height becomes smaller and a cross section area becomes smaller toward the front of the cooking appliance 1. Thus, the velocity of fluids in the exhaust duct 110 becomes higher and a pressure thereof becomes lower toward the front of the cooking appliance 1.

Specifically, the exhaust duct 110 includes a scroll unit 113 formed so that a radius is gradually increased in a clockwise rotation and an exhaust unit 114 formed in front of the scroll unit 113.

A suction port 115 through which fluids are suctioned into the exhaust duct 110 is formed in an upper portion of the scroll unit 113, and an exhaust port 116 through which the fluids are discharged is formed in the exhaust unit 114.

Therefore, the fluids suctioned into the exhaust duct 110 through the suction port 115 in the upper portion are guided by the scroll unit 113 to the exhaust unit 114 and are discharged to the front of the cooking appliance through the exhaust port 116.

Further, the exhaust unit 114 may be formed so that a height becomes gradually smaller and a cross section area becomes smaller toward the exhaust port 116 to generate the venturi effect.

The exhaust fan 120 may be a centrifugal flow fan or turbo fan which suctions fluids from above and discharges the fluids in a radial direction. The exhaust fan 120 may be disposed inside the exhaust duct 110.

The exhaust fan 120 may include a rotating plate 121, a hub 122 protruding upward from the center of the rotating plate 121, a plurality of wings 123 formed inward from edges of the rotating plate 121, and a shroud 124 connected to upper ends of the plurality of wings 123.

The hub 122 may be provided in a conical shape whose radius increases in a downward direction, and may diffuse fluids suctioned from above in a radial direction. The fluids diffused in the radial direction by the hub 122 may be discharged by the plurality of wings 123 in the radial direction of the exhaust fan 120.

The exhaust motor 130 generates a torque for driving the exhaust fan 120, and may include a stator 132 and a rotor 131. The stator 132 may include a bobbin 135 around which a coil 136 is wound, and a core 133 which forms a magnetic field when a current is applied to the coil 136.

The rotor 131 may rotate in one direction by a magnetic field generated by the core 133. One end of a rotating shaft 137 is connected to the rotor 131, and the rotating shaft 137 may be rotated with the rotor 131. The other end of the rotating shaft 137 may be connected to the exhaust fan 120. Like this, the exhaust fan 120 connected to the rotor 131 may be rotated with the rotor 131 by the rotating shaft 137.

The exhaust motor 130 may be supported by the support bracket 140. The support bracket 140 may include a base portion 147 supported by the exhaust duct 110 near the suction port 115, a motor coupling portion 141 formed to be spaced apart from the base portion 147 and coupled to the exhaust motor 130, and a bridge portion 146 connecting the base portion 147 and the motor coupling portion 141.

The base portion 147 may have a roughly donut shape, and may be coupled to the exhaust duct 110 near the suction port 115. The base portion 147 may include a bell-mouth portion 148 forming an inner suction port 148*a* through which fluids are suctioned into the exhaust duct 110.

The bell-mouth portion 148 may have a cross section in a shape of a roughly circular arc, and may reduce noise by preventing the generation of a vortex of the fluids being introduced into the exhaust duct 110 through the inner suction port 148*a*.

A planar portion 149*a* which extends to be roughly horizontal may be provided on an outer side of the bell-mouth portion 148, and a curved portion 149*b* which is formed to be smoothly sloped may be provided on an outer side of the planar portion 149*a*. As the curved portion 149*b* is put on the exhaust duct 110 near the suction port 115, the exhaust duct 110 may be supported by the support bracket 140.

Further, a hook protrusion 140*a* protruding downward is formed on the support bracket 140, a hook hole 110*a* into which the hook protrusion 140*a* is inserted is formed in the exhaust duct 110, then the hook protrusion 140*a* is inserted into the hook hole 110*a*, and thus the support bracket 140 may be coupled to the exhaust duct 110.

Meanwhile, the motor coupling portion 141 may include a core supporter 142 which supports the core 133 of the exhaust motor 130 mounted thereon, and a core guide 144 extending upward from an edge of the core supporter 142. The core guide 144 may have three surfaces aside from a surface coupled to the bobbin 135 of the exhaust motor 130. The core supporter 142 with the core guide 144 may form an accommodation space 145 which accommodates the core 133.

A coupling hole 133*a* may be formed in the stator 132 of the exhaust motor 130, and a coupling hole 142*a* may be formed in the core supporter 142 of the motor coupling portion 141 to correspond to the coupling hole 133*a*. Therefore, a coupling member, such as a screw or the like, is coupled to the coupling hole 133*a* and the coupling hole 142*a*, and thus the exhaust motor 130 may be firmly coupled to the motor coupling portion 141.

A height of a lower end 134 of the motor core 133 coupled to the motor coupling portion 141 is the same as a height of an upper end 111 of the exhaust duct 110 or smaller than that of the upper end 111 of the exhaust duct 110.

As described above, as the height of the lower end 134 of the motor core 133 is the same as that of the upper end 111 of the exhaust duct 110 or smaller than that of the upper end 111 of the exhaust duct 110, a height of the exhaust assembly 100 in the machine room 40, which is the greater portion of a height of the machine room 40, is decreased generally.

Therefore, the height of the machine room 40 may become smaller, and thus a height of the cooking chamber 20 may become larger as much as the lowered height of the machine room 40 and the capacity of the cooking chamber 20 may be increased.

Further, as the height of the lower end of the motor core 133 is the same as that of the upper end 111 of the exhaust duct 110 or smaller than that of the upper end 111 of the exhaust duct 110, the exhaust motor 130 and exhaust fan 120 are close to each other as a result, and thus cooling on the exhaust motor 130 itself is performed more efficiently.

Meanwhile, the exhaust duct 110 provided separately from the support bracket 140 has been described with reference to FIG. 4, but the exhaust duct 110 and the support bracket 140 may be formed integrally.

The sensor assembly 200 may be provided outside the cooking chamber 20 and may measure a gas of the cooking chamber 20. A type of gas detected by the sensor assembly 200 has no limit, but, for convenience of description, the following descriptions will be described assuming that the sensor assembly 200 detects steam.

The sensor assembly 200 is coupled to the through hole 31. Insides of the sensor assembly 200 and the cooking chamber 20 are in communication with each other by the through hole 31. Therefore, the fluids inside the cooking chamber 20 are introduced into the sensor assembly 200, and the amount of steam inside the cooking chamber 20 is detected using the fluids being introduced into the sensor assembly 200.

To precisely measure the amount of steam inside the sensor assembly 200, a flow of fluids being introduced into the sensor assembly 200 has to be uniform.

When the velocity of the fluids being introduced into the sensor assembly 200 becomes high, a degree of collection of steam is increased and the amount of steam measured by the sensor assembly 200 is increased. On the other hand, when the velocity of the fluids being introduced into the sensor assembly 200 becomes low, the degree of collection of steam is decreased and the amount of steam measured by the sensor assembly 200 is decreased.

That is, in order to precisely measure the amount of steam, the velocity of the fluids being introduced into the sensor assembly 200 has to be uniform such that the degree of collection of the steam is uniform. A uniform degree of collection of steam is provided to the sensor assembly 200 by a forcibly discharge of the exhaust assembly 100.

Specifically, since the above-described exhaust assembly 100 forcibly discharges the fluids inside the machine room 40 to the outside to generate a flow of a predetermined amount of fluids in the machine room 40, the sensor assembly 200 may be provided adjacent to the exhaust assembly 100 and may have a uniform degree of collection of steam.

As described above, since the degree of collection of steam in the sensor assembly is uniform by a flow of fluids uniformly generated by the exhaust assembly 100, the sensor assembly 200 may precisely measure the amount of steam inside the cooking chamber 20.

Particularly, the amount of steam inside the cooking chamber 20 may be precisely measured without an influence of the flow of the fluids caused by driving the above-described circulation fan 28. Hereinafter, the sensor assembly 200 will be described in detail.

Figure 5:
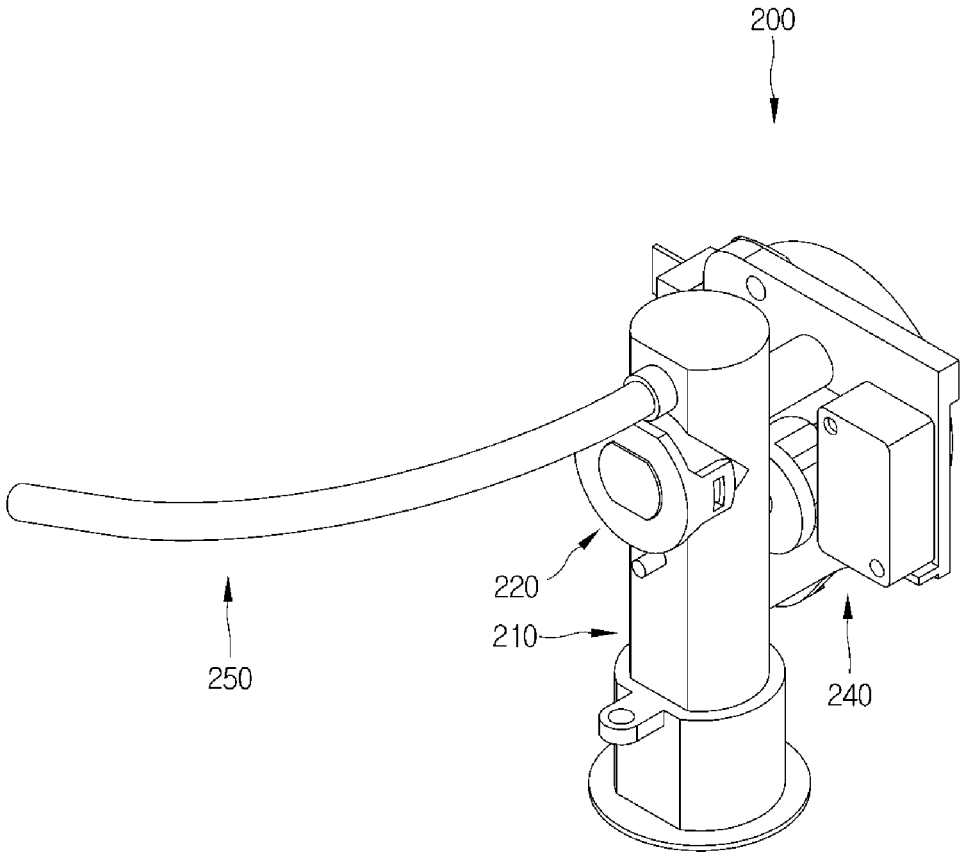
FIG. 5 is a perspective view of a sensor assembly provided in the cooking appliance according to one embodiment.
Figure 6:
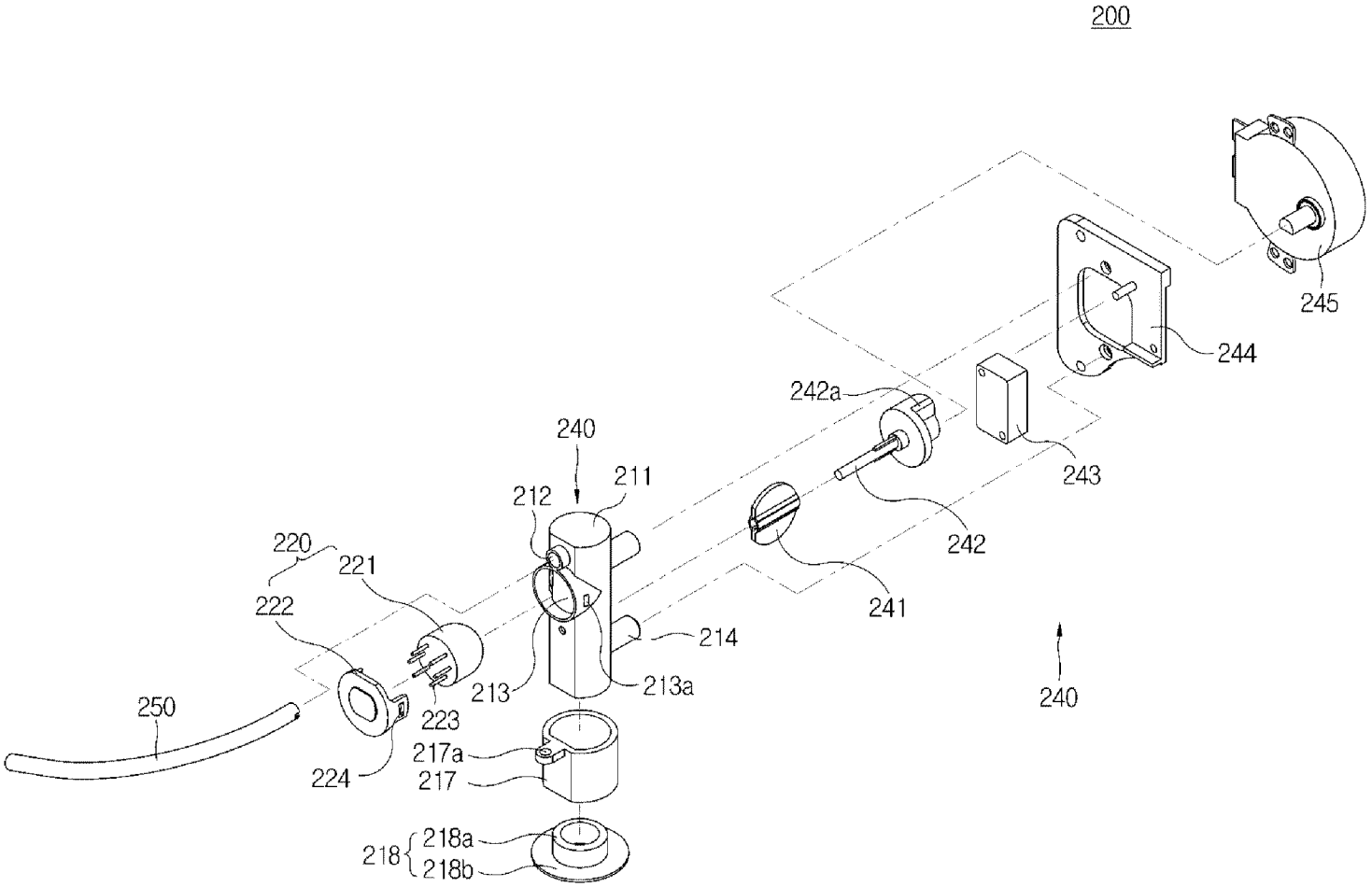
FIG. 6 is an exploded perspective view of the sensor assembly provided in the cooking appliance according to one embodiment.
Figure 7:
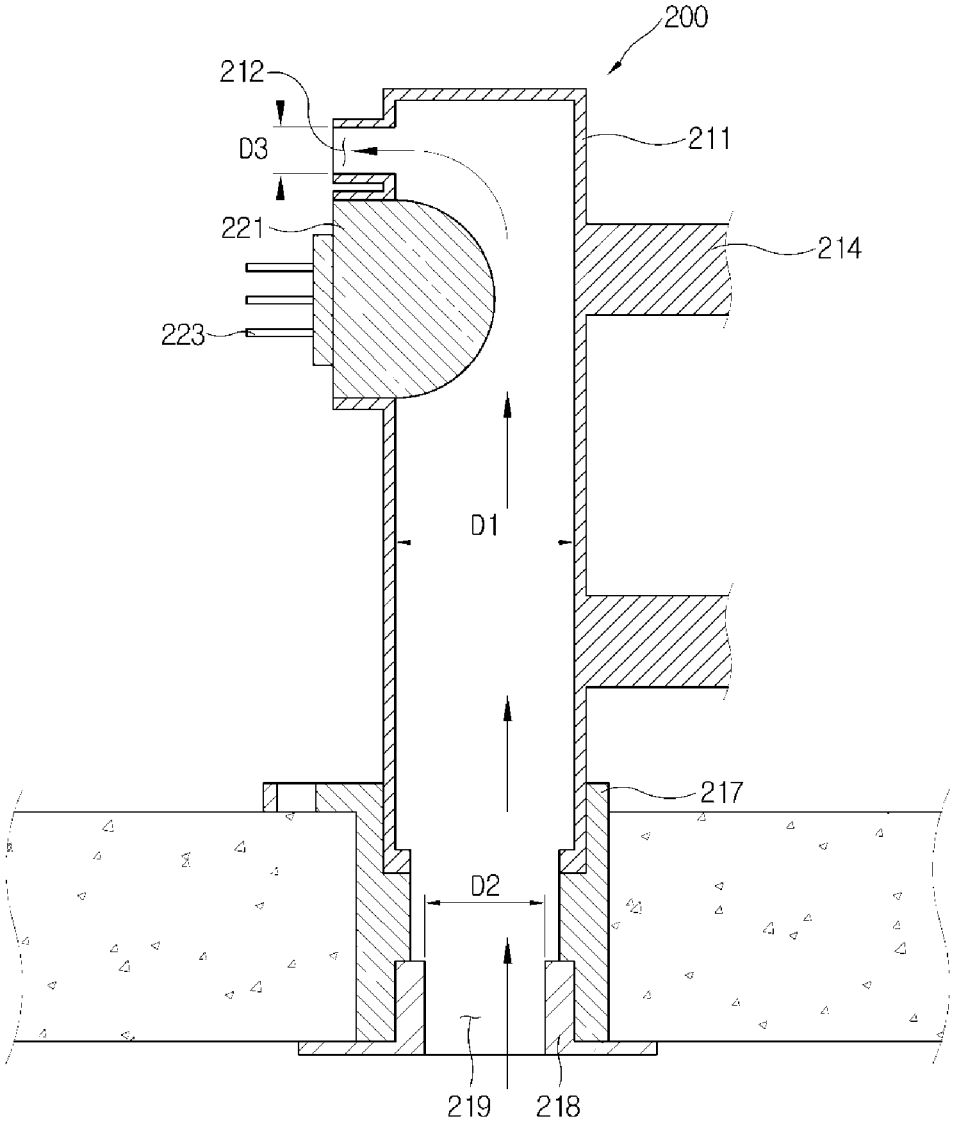
FIG. 7 is a cross-sectional view of the sensor assembly shown in FIG. 5.

FIG. 5 is a perspective view of a sensor assembly provided in the cooking appliance according to one embodiment, FIG. 6 is an exploded perspective view of the sensor assembly provided in the cooking appliance according to one embodiment, and FIG. 7 is a cross-sectional view of the sensor assembly shown in FIG. 5.

Figure 8A:
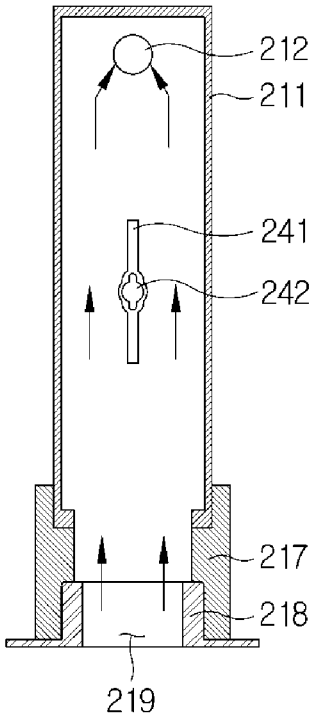
Figure 8B:
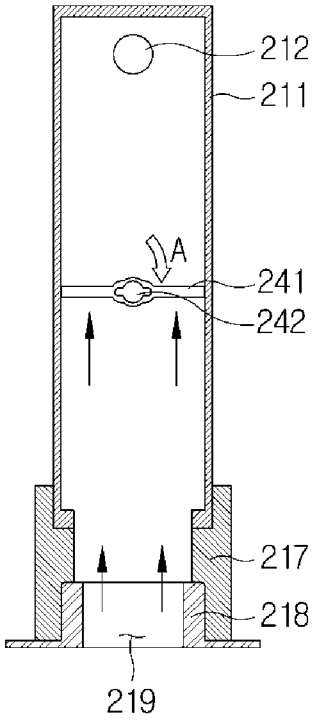
Figure 9:
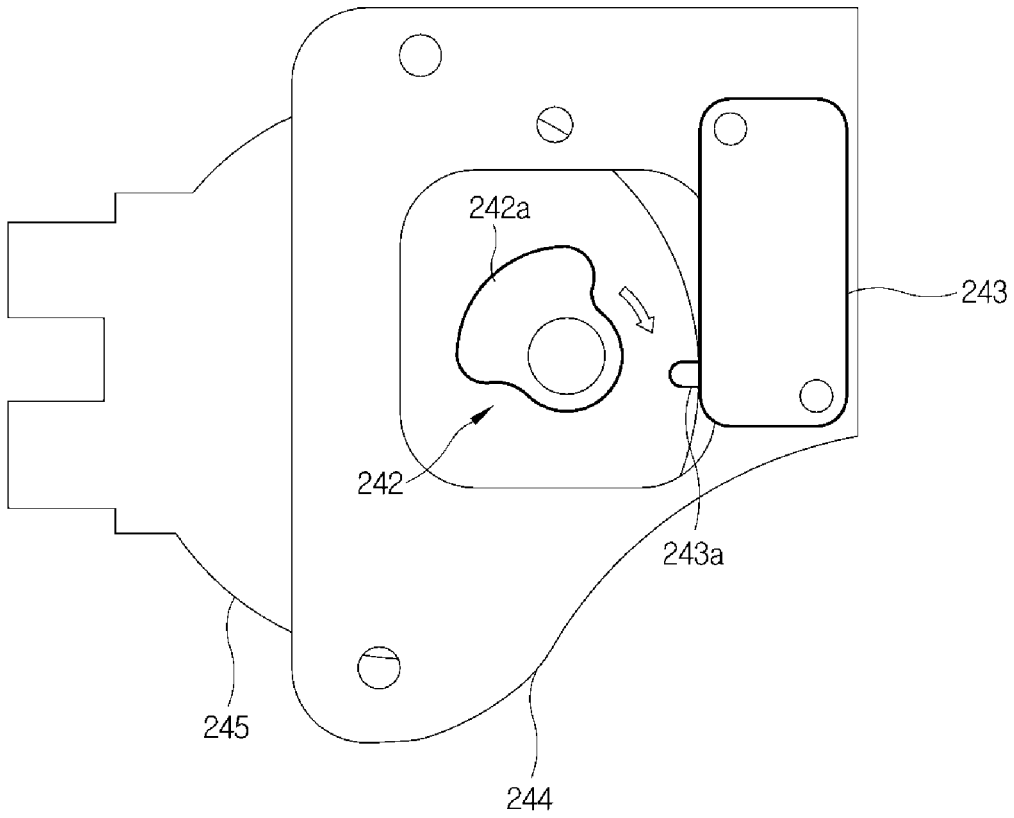
FIG. 9 is a view for describing an operation of a sensor valve.

FIG. 8A is a cross-sectional view of the sensor assembly when a flow path is opened, FIG. 8B is a cross-sectional view of the sensor assembly when the flow path is closed, and FIG. 9 is a view for describing an operation of a sensor valve.

Referring to FIGS. 5 to 7, the sensor assembly 200 may include a transfer unit 210 in communication with the cooking chamber 20 and a sensor unit 220 which detects the amount of steam of fluids flowing along the transfer unit 210.

The transfer unit 210 includes a transfer pipe 211 through which fluids flow, a sensor base portion 218 inserted into the through hole 31 to form an inlet 219, and a sensor coupling portion 217 coupling the transfer pipe 211 and the sensor base portion 218.

The transfer pipe 211 may have a schematically cylindrical shape, but the shape of the transfer pipe 211 is not limited thereto.

An upper portion of the transfer pipe 211 is closed, and a lower end of the transfer pipe 211 is open. The fluids in the cooking chamber 20 are introduced into the lower end of the transfer pipe 211 and flow to the upper portion of the transfer pipe 211.

A diameter D1 of the transfer pipe 211 may be determined so that dew condensation is not generated in the transfer pipe 211. For example, the transfer pipe 211 is provided to have a diameter of 5 pi or more so that the generation of dew condensation may be prevented in the transfer pipe 211.

An outlet 212 through which the fluids are discharged is provided at one side surface of the transfer pipe 211. The fluids introduced into the lower end of the transfer pipe 211 are discharged to the machine room 40 through the outlet 212.

Further, a sensor mounting portion 213 on which the sensor unit 220 is mounted is provided under the outlet 212. The sensor mounting portion 213 may be provided at a side surface the same as the side surface provided with the outlet 212, but the location of the sensor mounting portion 213 is not limited thereto.

Further, the sensor mounting portion 213 may be provided according to a shape of the sensor unit 220, and a sensor coupling protrusion 213*a* may be provided at an outer side surface of the sensor mounting portion 213. The sensor coupling protrusion 213*a* may be coupled to a sensor coupling groove 224 of a sensor guide 222 to be firmly coupled to the sensor unit 220 of the transfer pipe 211.

Meanwhile, a valve coupling portion 214 for fixing a blocking valve 240 may be provided at a side opposite the outlet 212.

The sensor coupling portion 217 couples the transfer pipe 211 and the sensor base portion 218. The sensor coupling portion 217 may be formed in a schematically cylindrical shape. Specifically, an outer side surface of the sensor coupling portion 217 is provided to have a shape corresponding to the through hole 31 provided between the cooking chamber 20 and the machine room 40.

The sensor coupling portion 217 may include a sensor hook protrusion 217*a*. The sensor hook protrusion 217*a* is provided at an upper portion of the sensor coupling portion 217. The sensor hook protrusion 217*a* is provided protruding toward the outside of the sensor coupling portion 217 to restrict the movement of the sensor coupling portion 217 in a direction of the cooking chamber 20.

The lower end of the transfer pipe 211 is coupled to the upper portion of the sensor coupling portion 217, and the sensor base portion 218 is coupled to a lower portion of the sensor coupling portion 217. To this end, an upper portion of an inner side of the sensor coupling portion 217 may be provided to have a shape corresponding to an outer circumferential surface of the transfer pipe 211, and the lower portion may be provided to have a shape corresponding to an outer circumferential surface of the sensor base portion 218.

The sensor base portion 218 includes an insertion portion 218*a* to be coupled to an inner surface of the lower portion of the sensor coupling portion 217 and a protrusion 218*b* extending outward along an outer circumferential surface of the insertion portion 218*a*.

The protrusion 218*b* is provided to have a radius greater than a radius of the through hole 31 to fix the sensor base portion 218 on an upper surface of the cooking chamber 20.

That is, a downward movement of the sensor assembly 200 is restricted by the sensor hook protrusion 217*a* of the sensor coupling portion 217, an upward movement thereof is restricted by the protrusion 218*b* of the sensor base portion 218, and thus, as shown in FIG. 7, the sensor assembly 200 is firmly fixed into the through hole 31.

An inlet 219 is formed in an inner side of the sensor base portion 218. The fluids inside the cooking chamber 20 flow into the sensor assembly 200 through the inlet 219.

As described above, when the fluids inside the machine room 40 are discharged to the outside by the exhaust assembly 100, a pressure of the machine room 40 becomes lower than a pressure of the cooking chamber 20.

Due to a pressure difference between the machine room 40 and the cooking chamber 20, the fluids inside the cooking chamber 20 are introduced into the transfer pipe 211 through the inlet 219, flow along the transfer pipe 211, and are discharged through the outlet 212 provided at the upper portion of the transfer pipe 211.

To make a uniform flow of fluids inside the transfer pipe 211 and prevent condensation of a steam sensor 221, a diameter D3 of the outlet 212 may be formed smaller than a diameter D2 of the inlet 219.

Specifically, the diameter D2 of the inlet 219 and the diameter D3 of the outlet 212 may be determined so that the velocity of the fluids flowing in the transfer pipe 211 becomes a minimum velocity or more. Here, the minimum velocity refers to a velocity at which the amount of moisture evaporated by flowing fluids are greater than the amount of moisture formed on a surface of the steam sensor 221.

For example, the diameter D2 of the inlet 219 and the diameter D3 of the outlet 212 are determined so that the velocity of the fluids in the transfer pipe 211 is 0.194 m/s or more, and thus the generation of condensation is prevented in the transfer pipe 211.

The sensor unit 220 measures the amount of steam of the fluids flowing in the transfer pipe 211. Specifically, the sensor unit 220 includes the steam sensor 221 which measures the amount of steam and the sensor guide 222 which fixes the steam sensor 221.

The steam sensor 221 measures the amount of steam of fluids, and there is no limit to the steam sensor 221 used in the cooking appliance 1 according to one embodiment.

For example, the steam sensor 221 may be classified as a resistive humidity sensor and a capacitive humidity sensor according to a detection method of steam.

The resistive humidity sensor is a sensor which detects the amount of steam using an impedance variation of a hygroscopic material, such as a conductive polymer or ceramic, coated between two metals, and the capacitive humidity sensor is a sensor which detects the amount of steam using a permittivity variation of a humidity sensitive material, such as a polymer thin film or metal oxide, located between two electrodes.

Specifically, the steam sensor 221 is mounted on the sensor mounting portion 213. A front end of the steam sensor 221 is provided protruding inside of the transfer pipe 211 to measure the amount of steam of fluids flowing from the inlet 219 to the outlet 212.

The fluids of which the amount of steam is measured by the steam sensor 221 are introduced from the cooking chamber 20, and the steam sensor 221 may measure the amount of steam inside the cooking chamber 20 using the fluids flowing in the transfer pipe 211.

The steam sensor 221 may be provided adjacent to the outlet 212 so that a degree of collection of steam is uniform. To this end, the sensor mounting portion 213 is provided adjacent to the outlet 212.

As described above, when the steam sensor 221 is provided adjacent to the outlet 212, fluids quickly flow around the steam sensor 221, then the degree of collection of steam by the steam sensor 221 becomes uniform, and thus due condensation generated on the surface of the steam sensor 221 may be prevented.

Further, a front surface of the steam sensor 221 may have a roughly hemispherical shape so that fluids smoothly flow around the steam sensor 221. Here, a curvature of the front surface of the steam sensor 221 may be determined to have a value in which the generation of condensation and ripples are minimized.

A sensor terminal 223 is provided at a rear surface of the steam sensor 221. The sensor terminal 223 is for electrically outputting a detected amount of steam, and the amount of steam detected from the steam sensor 221 is output as an electrical signal through the sensor terminal 223.

The sensor guide 222 fixes the steam sensor 221 to the transfer unit 210. The sensor guide 222 is coupled to the rear surface of the steam sensor 221. Sensor coupling grooves 224 to be coupled to the sensor coupling protrusion 213*a* are formed in both sides of the sensor guide 222, and thus the steam sensor 221 may be firmly fixed to the transfer unit 210.

Meanwhile, the sensor assembly 200 may further include an exhaust pipe 250. The exhaust pipe 250 extends the outlet 212 to a location adjacent to a cooling fan 51 of the exhaust assembly 100.

One end of the exhaust pipe 250 is coupled to the outlet 212 of the transfer unit 210 to guide fluids discharged from the outlet 212 to the other end thereof. The other end of the exhaust pipe 250 is provided adjacent to the exhaust fan 120 which discharges the fluids to the outside, and discharges the fluids introduced into one end of the exhaust pipe 250 in a direction of the exhaust fan 120. That is, the outlet 212 extends to a location adjacent to the exhaust fan 120 by the exhaust pipe 250.

At this point, since the other end of the exhaust pipe 250 is located more adjacent to the exhaust fan 120 than the outlet 212, a pressure of the other end of the exhaust pipe 250 becomes lower than a pressure of the outlet 212.

Therefore, since a pressure difference between the other end of the exhaust pipe 250, which serves as the outlet 212 and inlet 219 is further increased, as a result, the velocity of fluids passing through the sensor assembly 200 becomes higher due to the exhaust pipe 250.

As described above, when the velocity of the fluids passing through the sensor assembly 200 becomes higher, a degree of collection of steam becomes further uniform, and the generation of condensation is prevented, and thus the steam sensor 221 may measure the amount of steam of the cooking chamber 20 more precisely.

As a location of the other end of the exhaust pipe 250 is closer to the exhaust fan 120, the velocity of fluids becomes higher, and thus the velocity of the fluids flowing in the transfer pipe 211 may be controlled by adjusting the location of the other end of the exhaust pipe 250.

Meanwhile, the sensor assembly 200 may further include a blocking unit 240 for blocking a flow of fluids. The blocking unit 240 blocks fluids from being introduced, and may prevent fluids inside the machine room 40 from flowing into the cooking chamber 20. When the fluids inside the cooking chamber 20 are continuously introduced into the sensor assembly 200, a heat loss of the cooking appliance 1 is generated and failure of the steam sensor 221 may occur due to frequent exposure to the fluids.

Therefore, the blocking unit 240 blocks a flow path inside the transfer pipe 211 so that fluids are not introduced into the transfer pipe 211 when a measurement of the amount of steam is unnecessary, and thus a heat efficiency of the cooking appliance 1 is increased and the failure of the steam sensor 221 may be prevented.

The blocking unit 240 may include a throttle 241 which blocks a flow path, a cam shaft 242 for rotating the throttle 241, a valve motor 245 for driving the cam shaft 242, and a valve sensor 243 for detecting whether the flow path is blocked.

The throttle 241 may be provided between the inlet 219 and the sensor mounting portion 213, and the throttle 241 may be provided to have a shape corresponding to a shape of the flow path of the transfer pipe 211.

The valve motor 245 generates a torque for driving the throttle 241. The valve motor 245 may use a stepping motor capable of controlling a rotation angle, but the valve motor 245 is not limited thereto.

The throttle 241 is coupled to one end of the cam shaft 242, and the valve motor 245 is coupled to the other end of the cam shaft 242. When the valve motor 245 is driven, the cam shaft 242 is rotated, and the throttle 241 coupled to the cam shaft 242 is also rotated by the rotation of the cam shaft 242.

When the valve motor 245 is driven and the throttle 241 is located as shown in FIG. 8A, a flow path is opened. That is, when the throttle 241 is located parallel to a major axis of the transfer pipe 211, the flow path inside the transfer pipe 211 is opened. When the flow path is opened, the fluids inside the cooking chamber 20 are introduced through the inlet 219 and are discharged through the outlet 212.

Meanwhile, when the valve motor 245 is driven and the throttle 241 is located as shown in FIG. 8B, the flow path is closed. That is, when the throttle 241 is located perpendicular to the major axis of the transfer pipe 211, the flow path inside the transfer pipe 211 is closed by the throttle 241. As described above, when the flow path is closed by the throttle 241, the movement of the fluids inside the cooking chamber 20 is restricted, and thus heat inside the cooking chamber 20 may be maintained and the failure of the steam sensor 221 may be prevented.

Whether the flow path is blocked is sensed by the valve sensor 243. Referring to FIG. 9, the valve sensor 243 includes a switch 243*a* receiving an input by a cam knob 242*a*. The switch 243*a* may be provided protruding toward the cam shaft 242 to sense whether the flow path is blocked.

When the valve motor 245 is driven while the flow path is opened as shown in FIG. 8A, the cam shaft 242 rotates in a direction A, the throttle 241 connected to the cam shaft 242 is also rotated in the direction A, and thus the flow path is blocked as shown in FIG. 8B.

As described above, when the cam shaft 242 rotates, the cam knob 242*a* provided at the cam shaft 242 is also rotated in the direction A, and the switch of the valve sensor 243 is pressurized by the cam knob 242*a*. Therefore, when the switch 243*a* is pressurized by the cam knob 242*a*, the cooking appliance 1 may determine the flow path as a blocked state.

A valve guide 244 fixes the valve sensor 243 and the valve motor 245. The valve guide 244 may be coupled to the valve coupling portion 214 of the transfer unit 210 and the blocking unit 240 may be fixed to the transfer unit 210.

Hereinafter, an operation of the cooking appliance according to one embodiment will be described in detail.

Figure 10:
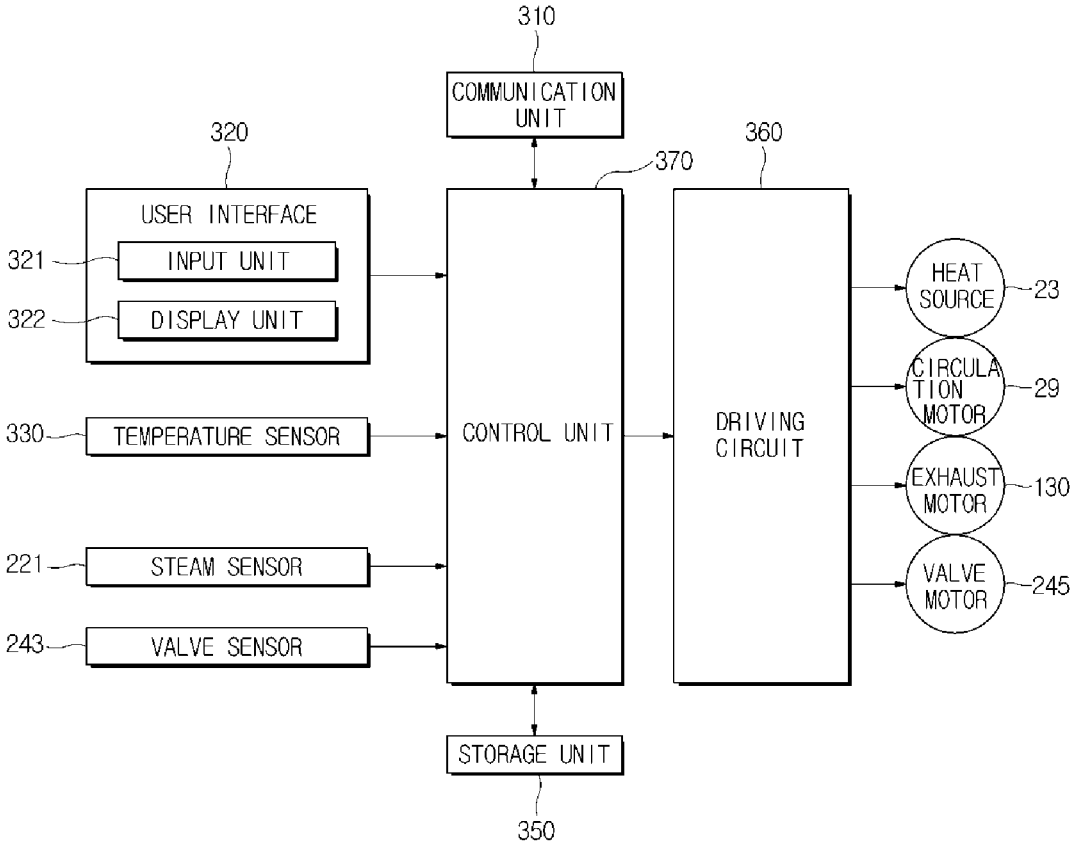
FIG. 10 is a control block diagram for describing an operation of the cooking appliance according to one embodiment.

FIG. 10 is a control block diagram for describing the operation of the cooking appliance according to one embodiment.

As shown in FIG. 10, the cooking appliance 1 according to one embodiment includes a communication unit 310, a user interface 320, a temperature sensor 330, a steam sensor 221, a valve sensor 243, a storage unit 350, a driving circuit 360, and a control unit 370.

The communication unit 310 is connected to an external device to transceive data with the external device. Specifically, the communication unit 310 may transmit information on whether cooking is complete to the external device, or may receive a control command from the external device.

A communication method between the external device and the communication unit 310 has no limit. For example, the communication unit 310 may communicate with an external device adjacent to the cooking appliance 1 using a short range communication method. Here, the short range communication method may be a communication method using Bluetooth, Bluetooth low energy, infrared data association (IrDA) communication, ZigBee, wireless fidelity (Wi-Fi), Wi-Fi direct, ultra wideband (UWB), or near field communication (NFC).

The user interface 320 is provided at a front surface of the cooking appliance 1 as shown in FIG. 1, and may receive a control command from a user and display information on a driving of the cooking appliance 1.

The user interface 320 may include an input unit 321 which receives the control command and a display unit 322 which displays information on the driving.

The input unit 321 may be implemented as at least one input unit of push buttons or membrane buttons, dials, slide switches, etc., but is not limited thereto.

The display unit 322 may be implemented as one display unit such as a plasma display panel (PDP), a liquid crystal display (LCD) panel, a light emitting diode (LED) panel, an organic LED (OLED) panel, an active-matrix OLED (AMOLED) panel, a curved display panel, etc., but is not limited thereto.

Further, the display unit 322 may be implemented as a touch screen panel (TSP) further including a touch input unit which senses a user's touch. When the display unit 322 is implemented as the TSP, a user may input a control command by touching the display unit 322.

The temperature sensor 330 may measure a temperature inside a cooking chamber 20. For example, the temperature sensor 330 may include at least one of a thermoresistor thermometer using a resistance variation of a metal based on a temperature variation, a thermister thermometer using a resistance variation of a semiconductor based on the temperature variation, a thermocouple thermometer using an electromotive force generated between two junction terminals of two types of metal lines having different materials, an integrated circuit (IC) thermometer using a voltage between two terminals of a transistor varying by a temperature or characteristics of a current and a voltage of a P-N junction, but is not limited thereto.

The storage unit 350 stores various types of information for driving the cooking appliance 1. Specifically, the storage unit 350 may store an operating system or program for driving the cooking appliance 1, or may store data for driving the cooking appliance 1.

For example, the storage unit 350 may store cooking information on food. The cooking information refers to a method of suitably cooking the food, and the cooking information may include at least one of a preheat temperature of the cooking chamber 20, a cooking temperature of the cooking chamber 20, and a cooking guide time.

Here, the cooking guide time may include a minimum cooking time predicted for the cooking the food and a maximum cooking time for preventing the burning of the food. That is, the minimum cooking time and the maximum cooking time for the food may be determined by the cooking guide time.

Further, since suitable cooking methods are different according to types of food, the cooking information may be provided by the types of food.

Further, the storage unit 350 may include a high-speed random access memory (RAM), a magnetic disc, a static RAM (SRAM), a dynamic RAM (DRAM), a read only memory (ROM), etc., but is not limited thereto.

Further, the storage unit 350 may be detachable from a device. For example, the storage unit 350 may include a compact flash (CF) card, a secure digital (SD) card, a smart media (SM) card, a multimedia card (MMC), or a memory stick, but is not limited thereto.

The driving circuit 360 may drive each device according to a control signal of the control unit 370. Specifically, the driving circuit 360 may heat the inside of the cooking chamber 20 by driving a heat source 23 according to the control signal.

Further, the driving circuit 360 drives a circulation motor 29 disposed in the cooking chamber 20 according to the control signal to operate a circulation fan 28, then a convection current of fluids inside the cooking chamber 20 is formed, and thus the cooking chamber 20 is uniformly heated.

Further, the driving circuit 360 drives an exhaust motor 130 provided in a machine room 40 according to the control signal to discharge fluids inside the machine room 40 to the outside, and thus the machine room 40 is cooled.

Further, the driving circuit 360 drives a sensor assembly 200 using a valve motor 245 provided at the sensor assembly 200 according to the control signal, and thus fluids being introduced may be blocked.

The control unit 370 outputs the control signal to generally control the cooking appliance 1. The control unit 370 may correspond to one or a plurality of processors. Here, the processor may be implemented as an array including a plurality of logic gates, or may be implemented as a combination of a general-purposed microprocessor and a memory in which a program executable in a microprocessor is stored.

Meanwhile, the control unit 370 is illustrated separately from the storage unit 350 in FIG. 10, but is not limited thereto, and the storage unit 350 and the control unit 370 may be formed as a single chip.

The control unit 370 may control each unit so that food is cooked according to a control command of a user.

Specifically, the control unit 370 may control a driving of the heat source 23 so that a set cooking temperature of the cooking chamber 20 is maintained on the basis of a temperature of the cooking chamber 20 detected from the temperature sensor 330.

Further, the control unit 370 controls the circulation motor 29 to uniformly transmit heat generated by the heat source 23 to the inside of the cooking chamber 20. A drive timing of the circulation motor 29 may be the same as a drive timing of the heat source 23, but is not limited thereto.

Further, the control unit 370 drives the exhaust motor 130 to cool the machine room 40 while cooking, and thus electrical units provided in the machine room 40 may be protected. That is, the exhaust motor 130 cools the machine room 40 by continuously driving at a predetermined speed while cooking and a predetermined time after the cooking is complete.

Hereinafter, a cooking method using the control unit 370 according to one embodiment will be described with reference to FIG. 11 in detail.

Figure 11:
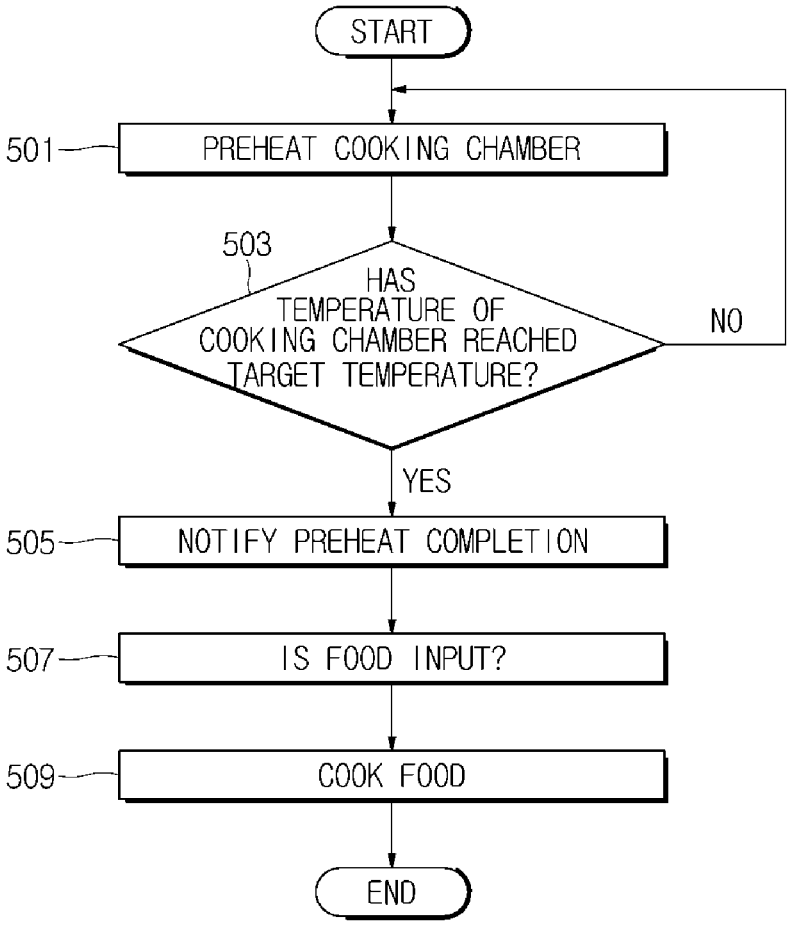
FIG. 11 is a flowchart illustrating one example of a cooking method of the cooking appliance according to one embodiment.

FIG. 11 is a flowchart illustrating one example of a cooking method of the cooking appliance according to one embodiment.

Referring to FIG. 11, the cooking appliance 1 preheats the cooking chamber 20 (S501). The heat source generates heat of the cooking chamber 20 according to a control of the control unit 370. Then, the circulation motor 29 is driven according to the control of the control unit 370 to circulate fluids of the cooking chamber 20 using the circulation fan 28.

Further, the exhaust motor 130 is driven according to the control of the control unit 370 to discharge fluids inside the machine room 40 to the outside, and thus electrical units may be protected.

The cooking appliance 1 determines whether a temperature of the cooking chamber 20 reaches a target temperature (S503). Specifically, the control unit 370 determines whether a temperature of the cooking chamber 20 detected by the temperature sensor 330 reaches the target temperature.

The target temperature refers to a preset cooking start temperature, and is preset by a user or manufacturer.

In addition, since cooking start temperatures are different depending on types of food, the target temperatures may be set differently on the basis of the types of food, and target temperatures according to cooking types may be pre-stored in the above-described storage unit 350 in a cooking information form.

When the temperature of the cooking chamber 20 does not reach the target temperature (no in S503), the cooking chamber 20 in the cooking appliance 1 is preheated continuously (S501).

When the temperature of the cooking chamber 20 reaches the target temperature (yes in S503), the cooking appliance 1 performs a preheat completion notification (S505). The preheat completion notification may be provided by the user interface 320, but is not limited thereto.

For example, the cooking appliance 1 may generate a sound to provide the preheat completion notification, or may provide the preheat completion notification to an external device capable of being connected through the communication unit 310.

The cooking appliance 1 determines whether food is input (S507). For example, when the cooking appliance 1 senses the door 12 closed again after the door 12 is opened, the cooking appliance 1 may determine that food is input into the cooking chamber 20 by the user, but the method of determining whether the food is input is not limited thereto.

For example, whether the food is input may be determined on the basis of a control command input through the user interface 320.

When the food is not input (no in S507), the cooking appliance 1 continuously performs the preheat completion notification (S505).

When the food is input (yes in S507), the cooking appliance 1 performs the cooking of the food (S509). Specifically, the cooking appliance 1 may control the heat source and the circulation motor so that the cooking chamber 20 maintains the cooking temperature. At this point, the cooking temperature may be the same as a set target temperature, but the set target temperature and the cooking temperature may be set differently.

Further, the cooking temperature may be set differently on the basis of the types of food, and may be stored in the storage unit 350 in the cooking information form with the cooking start temperature.

Further, the cooking appliance 1 may drive the circulation motor 29 to cool the machine room 40 while performing the cooking. Meanwhile, in operation S501 for preheating the cooking chamber 20, operation S507 may be omitted if necessary.

The cooking of the food may be performed for a time input through the user interface 320, but the cooking of the food may be performed automatically.

Specifically, the control unit 370 may perform an automatic cooking process. As the cooking proceeds, the amount of steam inside the cooking chamber 20 is increased and then changed to be gradually decreased. Accordingly, the automatic cooking process may be performed on the basis of a variation of the amount of steam detected from the sensor assembly 200.

Specifically, the evaporation of moisture included in the food is brisk at an initial cooking time, and thus the amount of steam in the cooking chamber 20 increases gradually. Otherwise, as the cooking time elapses, the moisture included in the food gradually decreases. Therefore, as the cooking time elapses, the evaporation of the moisture included in the food gradually decreases, and thus the amount of steam inside the cooking chamber 20 is decreased.

The variation of the amount of steam is precisely monitored by the above-described sensor assembly 200. Specifically, in the machine room 40, a forced discharge condition is uniformly made by the exhaust assembly 100. The fluids inside the cooking chamber 20 flow into the sensor assembly 200 at a predetermined velocity under the forced discharge condition made by the exhaust assembly 100.

Since the fluids inside the cooking chamber 20 flow into the sensor assembly 200 at the predetermined velocity, the steam sensor 221 provided inside the sensor assembly 200 may precisely detect the amount of steam inside the cooking chamber 20.

The control unit 370 may determine a completion point of cooking based on the amount of steam inside the cooking chamber 20 measured under the forced discharge condition of the exhaust assembly 100, and performs the automatic cooking process.

Here, the completion point of cooking may be determined on the basis of a cooking progress state. As described above, as the cooking proceeds, the amount of steam inside the cooking chamber 20 varies, and thus the control unit 370 determines the cooking progress state based on a variation of the amount of steam detected by the sensor assembly 200, and may determine the completion point of cooking according to the determined cooking progress state.

Hereinafter, a method of determining a completion point of cooking will be described in detail.

Figure 12:
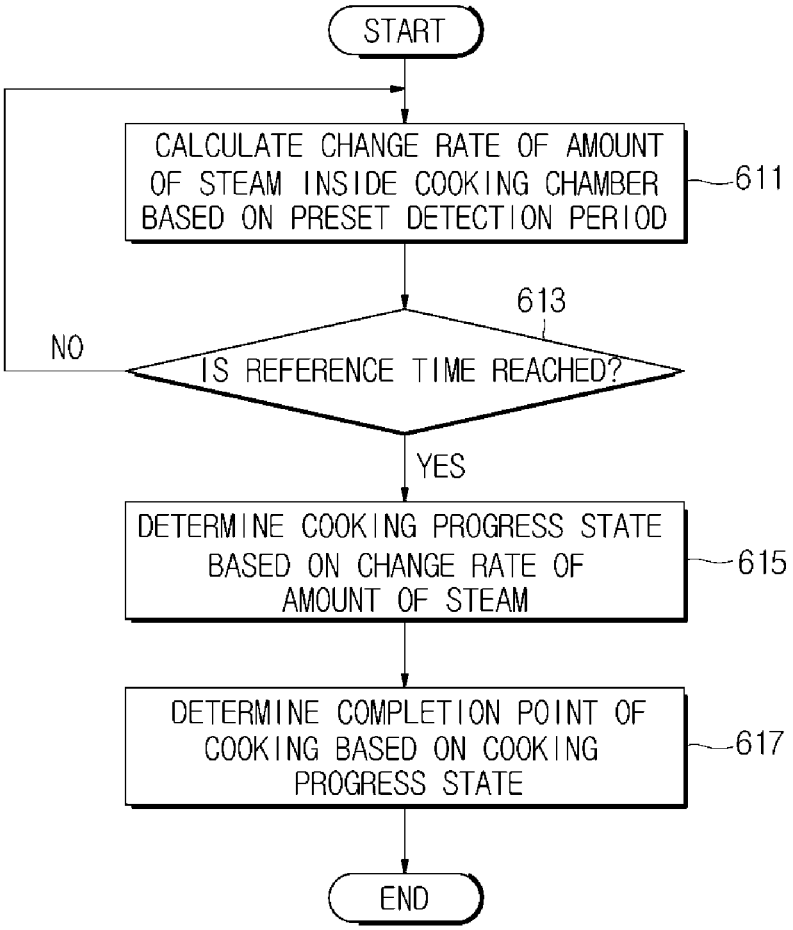
FIG. 12 is a flowchart illustrating one example of an automatic cooking method of the cooking appliance according to one embodiment.
Figure 13:
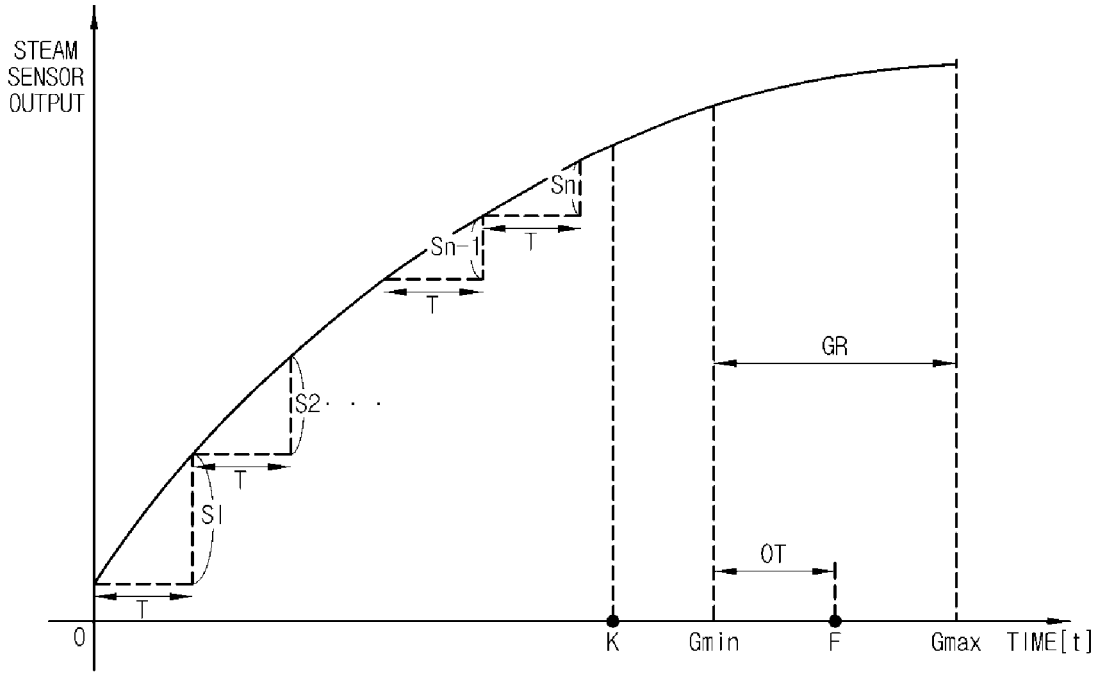
FIG. 13 is a graph for describing one example of a method of determining a completion point of cooking.
Figure 14A:
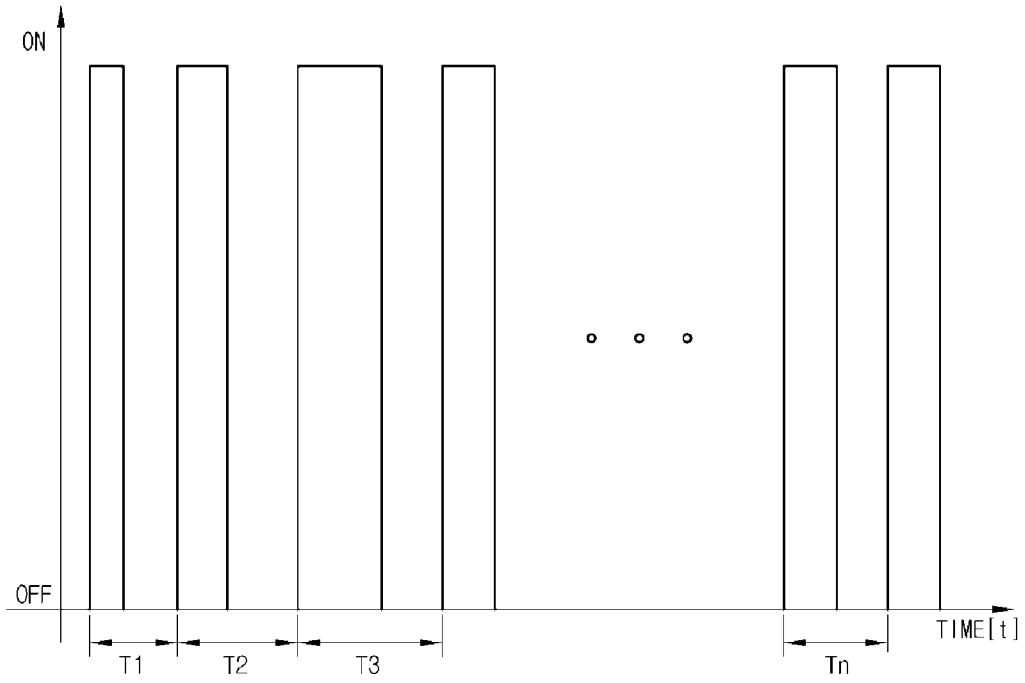
FIG. 14A is a view for describing one example of a detection period which is dynamically set.
Figure 14B:
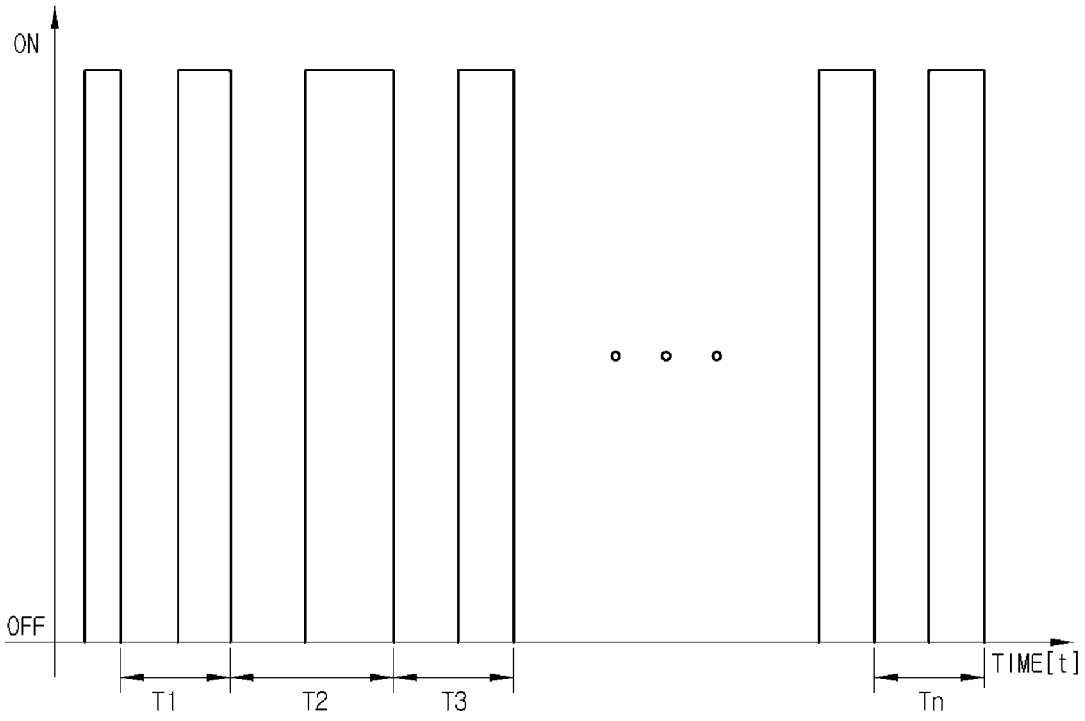
FIG. 14B is a view for describing another example of a detection period which is dynamically set.
Figure 14C:
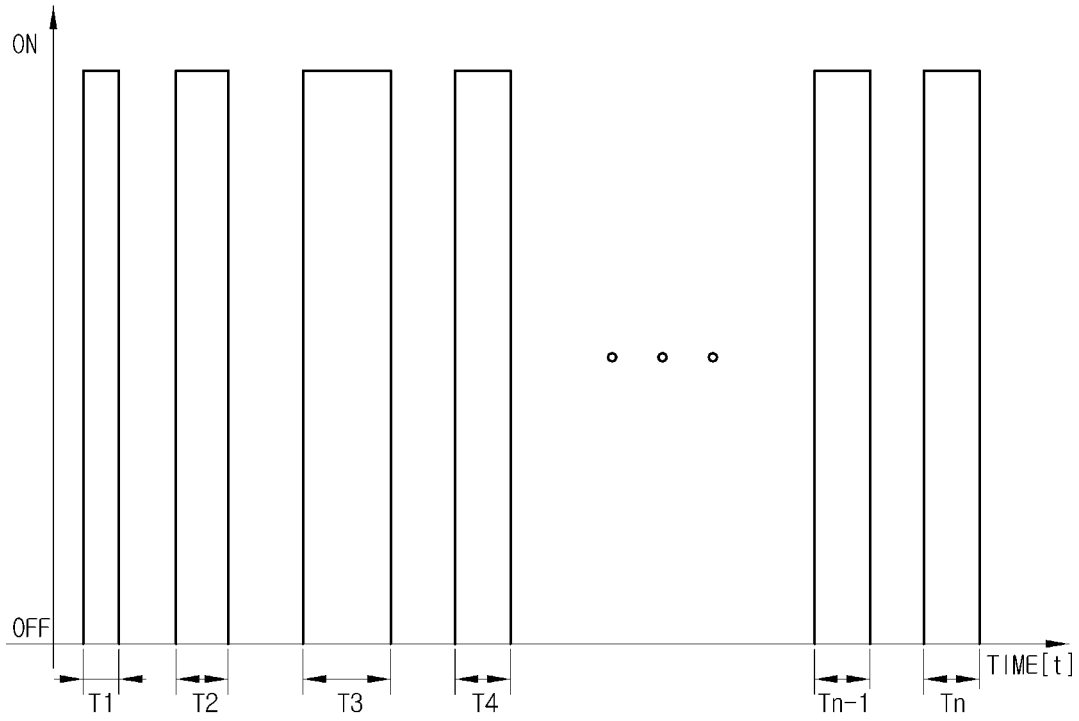
FIG. 14C is a view for describing still another example of a detection period which is dynamically set.

FIG. 12 is a flowchart illustrating one example of an automatic cooking method of the cooking appliance according to one embodiment, and FIG. 13 is a graph for describing one example of a method of determining a completion point of cooking. FIG. 14A is a view for describing one example of a detection period which is dynamically set, FIG. 14B is a view for describing another example of a detection period which is dynamically set, and FIG. 14C is a view for describing still another example of a detection period which is dynamically set.

Referring to FIGS. 12 and 13, the cooking appliance 1 calculates a change rate of the amount of steam inside the cooking chamber 20 based on a preset detection period (S611). The cooking appliance 1 may detect the amount of steam using the steam sensor 221 provided at the sensor assembly 200.

The steam sensor 221 detects the amount of steam of fluids inside the cooking chamber 20 flowing into the exhaust assembly 100, and outputs an electrical signal corresponding to the detected amount of steam. For example, the steam sensor 221 may output an electrical signal as shown in FIG. 13.

The control unit 370 calculates a change rate of the amount of steam based on the detected amount of steam by the steam sensor 221. The calculation of the change rate of the amount of steam may be continuously performed according to a preset detection period T as shown in FIG. 13.

Specifically, the change rate of the amount of steam may be calculated by the following Equation 1.

$$\Delta_n = \frac{l_n}{T} \quad \text{[Equation 1]}$$

Here, $\Delta_n$ denotes a change rate of the amount of steam in an nth detection period, T denotes a detection period in which the change rate of the amount of steam is calculated, and $l_n$ denotes a variation of the amount of steam in the nth detection period.

That is, the control unit 370 calculates a change rate $\Delta_n$ of the amount of steam in each predetermined detection period T, and may obtain the change rate $\Delta_n$ of the amount of steam according to a cooking time being elapsed.

Meanwhile, the detection period T in which the change rate $\Delta_n$ of the amount of steam is calculated may be preset, but is not limited thereto, and the detection period T in which the change rate $\Delta_n$ of the amount of steam may be dynamically determined according to an operation of the cooking appliance 1.

For example, the detection period may be dynamically determined on the basis of an operation of the heat source 23 of the cooking appliance 1.

Since the heat source 23 is controlled so that a temperature of the cooking chamber 20 is maintained at a cooking temperature, as shown in FIG. 14, the heat source 23 operates in an ON state in which heat is generated and an OFF state in which heat is not generated. The control unit 370 may set detection periods T1 to Tn based on the states of the heat source.

As shown in FIG. 14A, the detection periods T1 to Tn may be determined on the basis of a start point of the ON state in which the heat source operates. Specifically, the detection periods T1 to Tn may be determined in the manner of determining a first detection period T1 from a point at which a state in which the heat source is converted a first time into the ON state to a point at which the state of the heat source is converted into the ON state again, and a second detection period T2 from a point at which the state of the heat source is converted a second time into the ON state to a point at which the state of the heat source is converted a third time into the ON state.

When the detection periods T1 to Tn are determined on the basis of the ON state of the heat source, lengths of the plurality of detection periods T1 to Tn may be determined differently.

Meanwhile, the detection periods T1 to Tn may be determined on the basis of a start point of a turn-off state in which a driving of the heat source stops as shown in FIG. 14B, or may be determined on the basis of a maintaining time of the ON state in which the heat source is driven as shown in FIG. 14C.

When the detection periods T1 to Tn are dynamically set as shown in FIGS. 14A to 14C, the detection periods T1 to Tn vary dynamically, and thus the control unit 370 may calculate a change rate of the amount of steam in each detection period according to the following Equation 2.

$$\Delta_n = \frac{l_n}{T_n} \quad \text{[Equation 2]}$$

Here, Tn denotes a length of an nth detection period.

Referring to again to FIGS. 12 and 13, the cooking appliance 1 determines whether a reference time K is reached (S613). The reference time K refers to a state in which the change rate of the amount of steam is obtained to the point that a cooking progress state is predictable, and may be a preset value. Further, the reference time K may be set differently on the basis of a type of food.

When the reference time K is not reached (no in S613), the cooking appliance 1 continuously calculates the change rate of the amount of steam of the cooking chamber 20 based on the detection period (S611).

When the reference time K is reached (yes in S613), the cooking appliance 1 determines a cooking progress state based on the change rate of the amount of steam (S615). The control unit 370 may determine the cooking progress state of the food using a plurality of change rates of the amount of steam obtained before the reference time K.

For example, the cooking progress state may be determined on the basis of the maximum change rate of the amount of steam among the plurality of change rates of the amount of steam and the last change rate of the amount of steam measured at a closest time to the reference time K.

Specifically, the control unit 370 may determine the cooking progress state of the food based on the following Equation 3.

$$R = \frac{\Delta_k}{\max(\Delta_1, \Delta_2, \ldots, \Delta_k)} \quad \text{[Equation 3]}$$

Here, R in Equation 3 denotes a cooking progress state. As seen in Equation 3, the control unit 370 may determine the cooking progress state R based on a ratio of a last change rate $\Delta_k$ of the amount of steam measured at just before the reference time to the maximum change rate of steam among the plurality of change rates $\Delta_1$ to $\Delta_n$ of steam.

That is, as the last change rate $\Delta_k$ of the amount of steam is similar to the maximum steam change rate, moisture evaporation of the food is determined as more active, and thus the cooking progress state R is determined as the cooking needing further progress.

On the other hand, as a difference between the last change rate $\Delta_k$ of the amount of steam and the maximum change rate of steam becomes great, the cooking progress state R is determined as the state of cooking nearing a completion state.

The cooking appliance 1 determines a completion point of cooking based on the cooking progress state R (S617). The control unit 370 calculates an optimum cooking time OT needed for cooking completion based on the cooking progress state R and determines a completion point of cooking F.

At this point, the optimum cooking time OT may be determined proportional to the cooking progress state R.

Further, the optimum completion point F may be determined within a preset range of cooking guide time. When the optimum cooking time OT is determined only on the basis of the cooking progress state R, the optimum cooking time OT is set to be excessively short so that the cooking is completed before a suitable cooking state, or the optimum cooking time OT is set to be excessively long so that the food may be burnt.

Therefore, the control unit 370 may calculate the optimum cooking time OT so that the completion point of cooking F is determined within the preset range of cooking guide time. For example, the control unit 370 may calculate the optimum completion point according to the following Equation 4.

$$F = G\min + OT \qquad \text{[Equation 4]}$$
$$= G\min + (G\max - G\min)^{*} R$$

Here, F denotes a completion point of cooking, OT denotes an optimum cooking time, Gmin denotes a minimum cooking time within a range of guide cooking time, and Gmax denotes a maximum cooking time within the range of guide cooking time.

The optimum cooking time OT may be calculated by multiplying a range of cooking guide time (Gmax-Gmin) GR by the cooking progress state R. That is, the optimum cooking time OT is set within a range of cooking guide time (Gmax-Gmin) GR.

Meanwhile, the reference time K is shown as being set before the minimum cooking time in FIG. 13, but the reference time K may be set within the range of cooking guide time (Gmax-Gmin) GR. For example, the reference time K may be set to be the same as the minimum cooking time within the range of cooking guide time.

Figure 15:
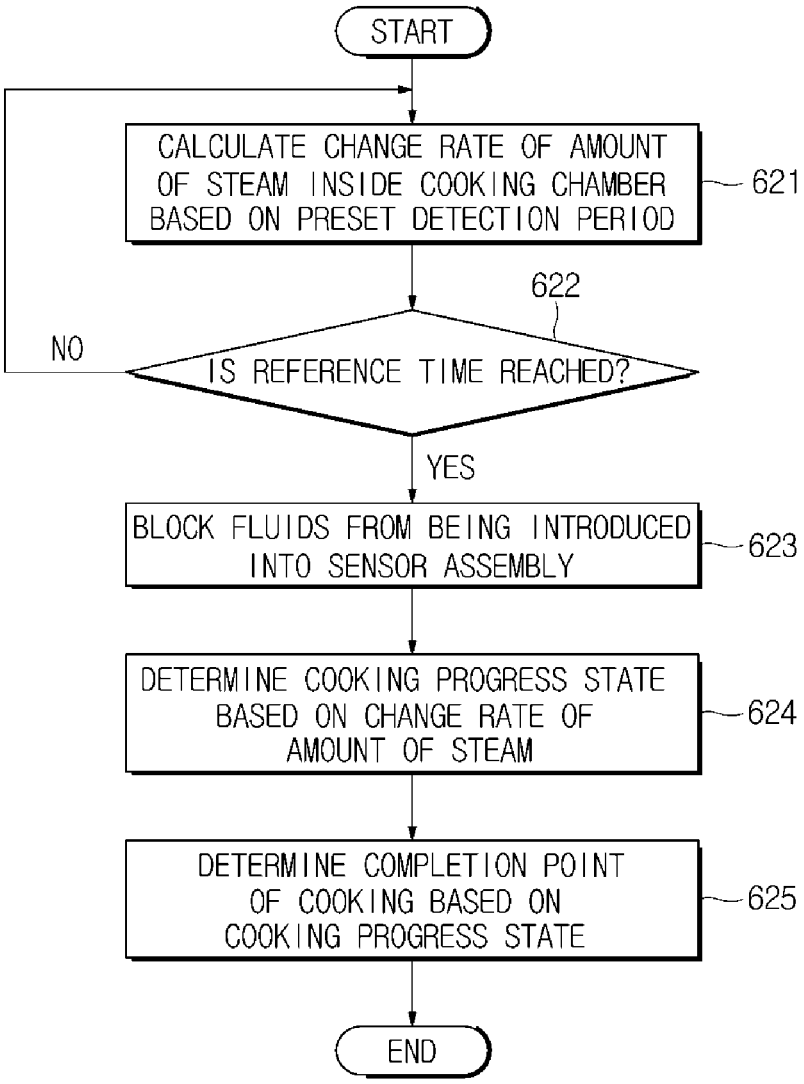
FIG. 15 is a flowchart illustrating another example of an automatic cooking method of the cooking appliance according to one embodiment.

FIG. 15 is a flowchart illustrating another example of an automatic cooking method of the cooking appliance according to one embodiment.

Referring to FIG. 15, the cooking appliance 1 calculates a change rate of the amount of steam inside the cooking chamber 20 based on a preset detection period (S621). The cooking appliance 1 may detect the amount of steam inside the cooking chamber 20 using the steam sensor 221 provided at the sensor assembly 200.

The control unit 370 calculates the change rate of the amount of steam based on the amount of steam detected by the steam sensor 221. At this point, the change rate of the amount of steam may be calculated by the above-described Equation 1 or Equation 2.

The cooking appliance 1 determines whether a reference time is reached (S622). Here, the reference time may be set differently from a cooking guide time, or may be set within a range of cooking guide time.

When the reference time is not reached (no in S622), the cooking appliance 1 continuously calculates the change rate of the amount of steam inside the cooking chamber 20 based on the preset detection period (S621).

When the reference time is reached (yes in S622), the cooking appliance 1 blocks fluids from being introduced into the sensor assembly 200 (S623). The control unit 370 may control the blocking unit 240 of the sensor assembly 200 so that the fluids inside the cooking chamber 20 are not introduced into the sensor assembly 200.

Specifically, the control unit 370 drives the valve motor 245 so that the throttle 241 is located perpendicular to the major axis of the transfer pipe 211 as shown in FIG. 8B. When the throttle 241 moves perpendicularly to the major axis of the transfer pipe 211, the flow path formed in the transfer pipe 211 is closed by the throttle 241, and thus the fluids inside the cooking chamber 20 are no longer introduced into the sensor assembly 200.

At this point, a location of the throttle 241 may be detected by the valve sensor 243 of the sensor assembly 200.

That is, when the monitoring of a variation of the amount of steam needed for determining a cooking state is completed, the cooking appliance 1 blocks the fluids from being introduced into the sensor assembly 200. Since the fluids being introduced into the sensor assembly 200 are blocked, a heat loss in the cooking chamber 20 may be minimized and the steam sensor 221 may be protected.

The cooking appliance 1 determines a cooking progress state based on the change rate of the amount of steam (S624). The control unit 370 may determine the cooking progress state of the food using a plurality of change rates of the amount of steam obtained before the reference time. For example, the cooking progress state of the food may be determined on the basis of the above-described Equation 3.

The cooking appliance 1 determines a completion point of cooking based on the cooking progress state (S625). The control unit 370 calculates an optimum cooking time needed for cooking completion based on the cooking progress state and determines the completion point of cooking. At this point, the completion point of cooking may be determined by the above-described Equation 4.

Figure 16:
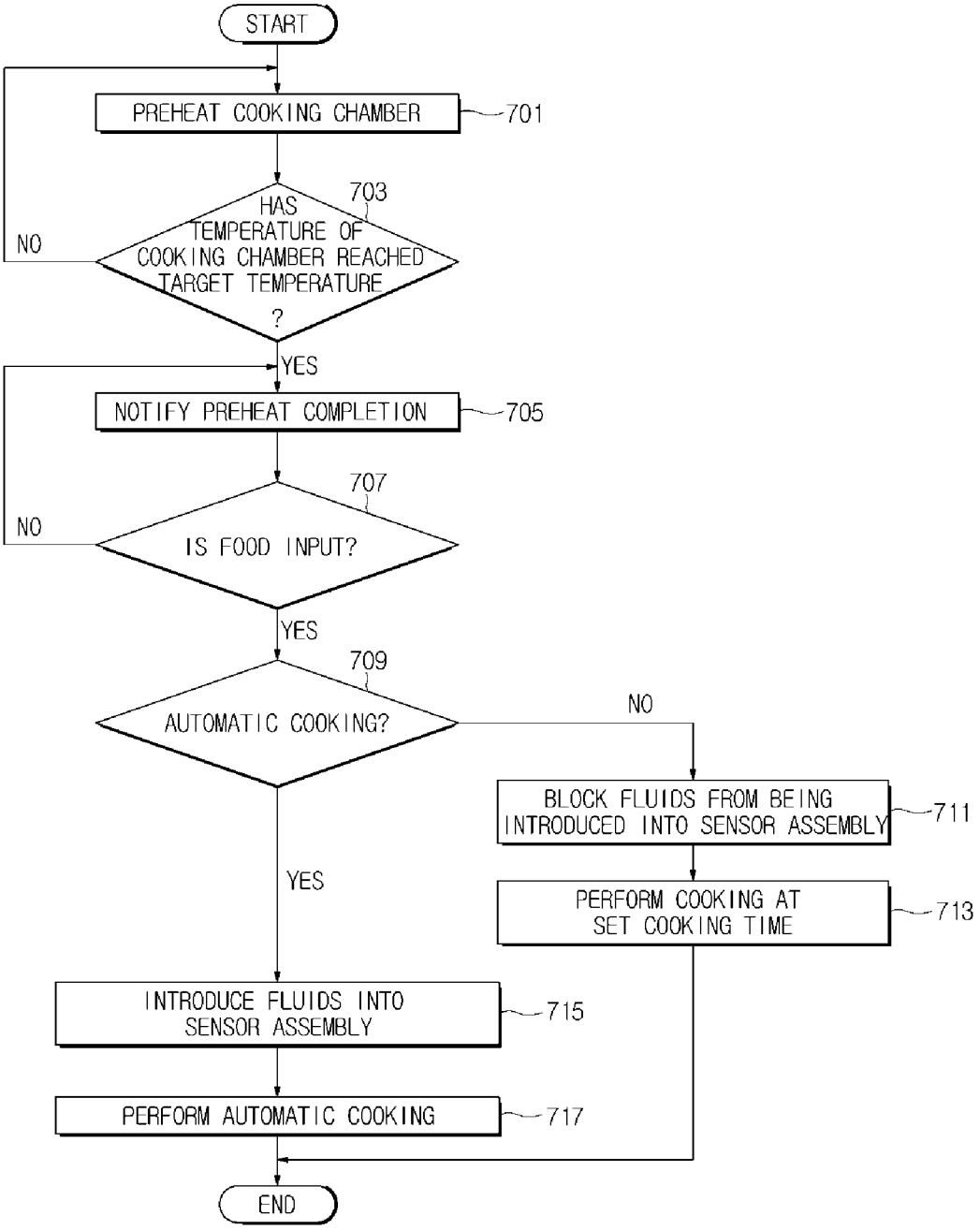
FIG. 16 is a flowchart illustrating another example of a cooking method of the cooking appliance according to one embodiment.

FIG. 16 is a flowchart illustrating another example of a cooking method of the cooking appliance according to one embodiment.

Referring to FIG. 16, the cooking appliance 1 preheats the cooking chamber 20 (S701). The heat source generates heat of the cooking chamber 20 according to a control of the control unit 370. Further, the circulation motor 29 is driven according to the control of the control unit 370 and fluids inside the cooking chamber 20 are circulated by the circulation fan 28.

Further, the exhaust motor 130 is driven according to the control of the control unit 370 to discharge fluids inside the machine room 40 to the outside, and thus electrical units may be protected.

The cooking appliance 1 determines whether a temperature of the cooking chamber 20 reaches a target temperature (S703). Specifically, the control unit 370 determines whether the temperature of the cooking chamber 20 detected by the temperature sensor 330 reaches the target temperature.

When the temperature of the cooking chamber 20 does not reach the target temperature (no in S703), the cooking appliance 1 continuously preheats the cooking chamber 20 (S701).

When the temperature of the cooking chamber 20 reaches the target temperature (yes in S703), the cooking appliance 1 performs a preheat completion notification (S705). The preheat completion notification may be provided through the user interface 320, or provided through an external device.

The cooking appliance 1 determines whether food is input (S707). When the food is not input (no in S707), the cooking appliance 1 continuously performs the preheat completion notification (S705).

Meanwhile, when the food is input (yes in S707), the cooking appliance 1 determines whether an automatic cooking is selected (S709). That is, the cooking appliance 1 determines whether the automatic cooking is selected by a user.

When the automatic cooking is not selected (no in S709), the cooking appliance 1 blocks fluids from being introduced into the sensor assembly 200 (S711), and the cooking is performed according to a cooking time set by the user (S713).

At this point, the cooking appliance 1 may determine whether the fluids are blocked on the basis of an output value of the valve sensor 243. That is, the cooking appliance 1 determines a location of the throttle 241 based on the output value of the valve sensor 243, and drives the valve motor 245 to move the throttle 241 in a direction perpendicular to the major axis of the transfer pipe 211 as shown in FIG. 8B.

When the automatic cooking is selected (yes in S709), the cooking appliance 1 introduces the fluids into the sensor assembly 200 (S715), and the automatic cooking is performed (S717).

Specifically, the cooking appliance 1 determines the location of the throttle 241 based on the output value of the valve sensor 243, drives the valve motor to move the throttle 241 in a direction parallel to the major axis of the transfer pipe 211 as shown in FIG. 8A, and thus a flow path of the sensor assembly 200 may be opened.

Further, the steam sensor 221 of the sensor assembly 200 measures the amount of steam of fluids flowing in the transfer pipe 211, and the control unit 370 performs the automatic cooking based on the amount of steam detected by the steam sensor 221.

While performing the automatic cooking, as described with reference to FIG. 15, when the reference time is passed, the fluids being introduced into the sensor assembly 200 may be blocked again.

Figure 17:
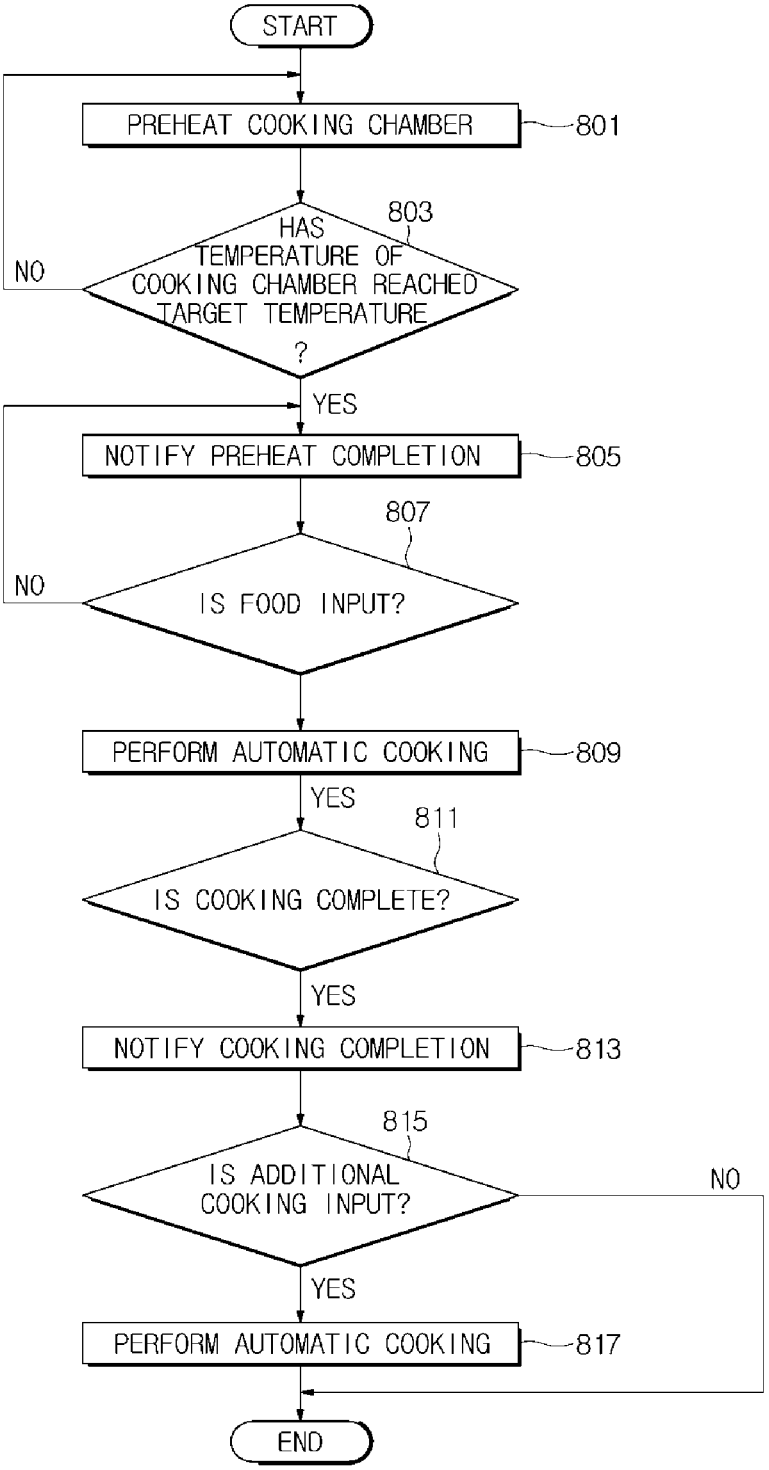
FIG. 17 is a flowchart illustrating still another example of a cooking method of the cooking appliance according to one embodiment.
Figure 18:
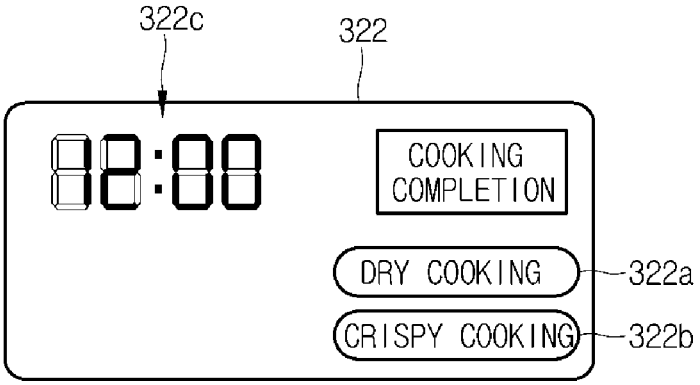
FIG. 18 is a view illustrating one example of a cooking completion display screen of the cooking appliance according to one embodiment.
Figure 19:
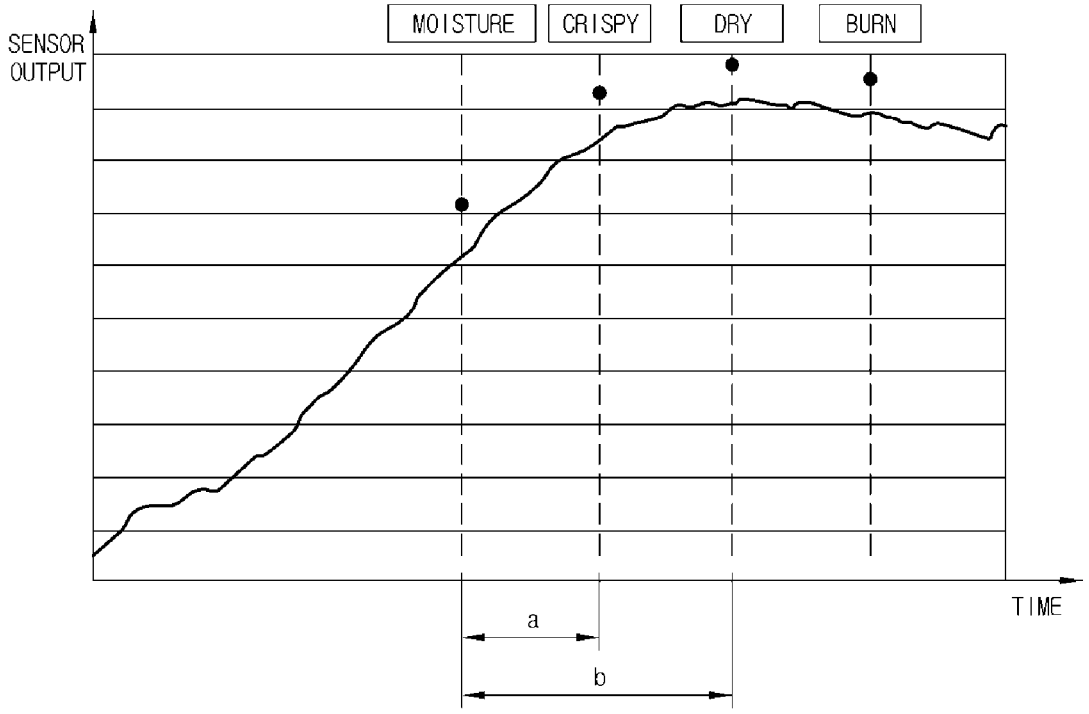
FIG. 19 is a graph for describing an additional cooking process in the cooking appliance according to one embodiment.

FIG. 17 is a flowchart illustrating still another example of a cooking method of a cooking appliance according to one embodiment, FIG. 18 is a view illustrating one example of a cooking completion display screen of the cooking appliance according to one embodiment, and FIG. 19 is a graph for describing an additional cooking process in the cooking appliance according to one embodiment.

Referring to FIG. 17, the cooking appliance 1 preheats the cooking chamber 20 (S801). The heat source 23 generates heat of the cooking chamber 20 according to a control of the control unit 370. Further, the circulation motor 29 is driven according to the control of the control unit 370 and fluids inside the cooking chamber 20 are circulated by the circulation fan 28.

Further, the exhaust motor 130 is driven according to the control of the control unit 370 to discharge fluids inside the machine room 40 to the outside, and thus electrical units may be protected.

The cooking appliance 1 determines whether a temperature of the cooking chamber 20 reaches a target temperature (S803). Specifically, the control unit 370 determines whether the temperature of the cooking chamber 20 detected by the temperature sensor 330 reaches the target temperature.

When the temperature of the cooking chamber 20 does not reach the target temperature (no in S803), the cooking appliance 1 continuously preheats the cooking chamber 20 (S801).

When the temperature of the cooking chamber 20 reaches the target temperature (yes in S803), the cooking appliance 1 performs a preheat completion notification (S805). The preheat completion notification may be provided through the user interface 320, or provided through an external device.

The cooking appliance 1 determines whether food is input (S807). When the food is not input (no in S807), the cooking appliance 1 continuously performs the preheat completion notification (S805).

Meanwhile, when the food is input (yes in S807), the cooking appliance 1 performs an automatic cooking (S809). Specifically, the cooking appliance 1 determines a cooking progress state based on a change rate of the amount of steam measured by the sensor assembly 200, and a completion point of cooking may be determined on the basis of the determined cooking progress state.

The cooking appliance 1 determines whether the cooking is completed (S811). Specifically, the cooking appliance 1 determines whether a completion point of cooking calculated on the basis of the above-described method is passed, and when the completion point of cooking is passed, the cooking appliance 1 may determine the cooking is completed.

When the cooking is completed (yes in S811), the cooking appliance 1 performs a cooking completion notification (S813). The cooking completion notification may be provided through the user interface 320, or the cooking completion notification may be provided using an external device capable of being connected with the communication unit 310.

For example, the cooking appliance 1 may display a cooking completion through the user interface 320 as shown in FIG. 18.

Further, the cooking appliance 1 monitors input of an additional cooking command (S815). A user may input an additional cooking command according to the demand by the user. That is, the user may input an additional cooking command for a desired cooking state using the user interface 320 or an external device connected to the communication unit 310.

For example, when the food is a pizza, as shown in FIG. 19, the pizza is cooked in a moist cooking state, a crispy cooking state, or a dried cooking state according to a time of cooking.

When an automatic cooking of the pizza is completed in the moist cooking state, the user may input an additional cooking command by selecting a dry cooking icon 322*a* or crispy cooking icon 322*b* shown in FIG. 18.

When the additional cooking command is input (yes in S815), the cooking appliance 1 performs an additional cooking process.

An additional cooking time may be determined according to an additional cooking command selected by the user. For example, when the user selects the crispy state, the cooking appliance 1 may perform an additional cooking process for time a, and when the user selects the dry state, the additional cooking process may be performed for time b.

Further, the additional cooking time may be determined according to a variation of the amount of steam measured in the automatic cooking process. The additional cooking time may be determined using the above-described method of calculating the completion point of cooking.

Specifically, the cooking appliance 1 may determine an additional cooking time to be a state selected by the user according to a change rate of steam before a reference time or until a completion point of cooking. That is, the additional cooking time may be determined on the basis of a maximum variation amount of steam and a variation amount of steam in a last detection period.

Further, the additional cooking time may be set within a preset range of cooking guide time, and thus it may prevent the food from being burned by the additional cooking process.

The above determined additional cooking time may be displayed on a time display unit 322*c* as shown in FIG. 18.

Figure 20:
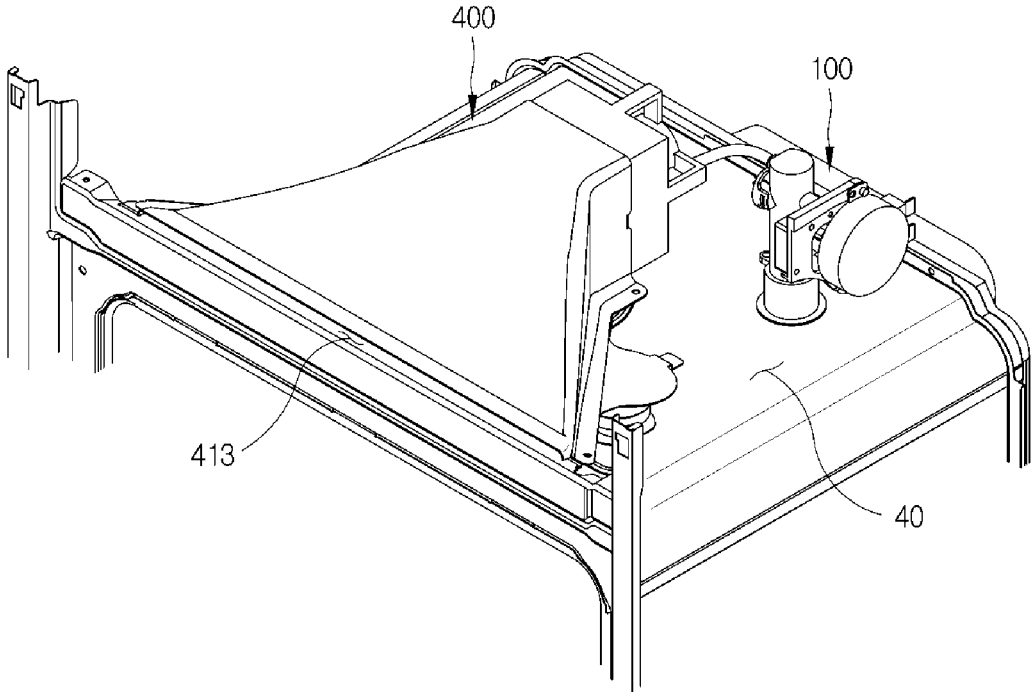
FIG. 20 is a perspective view schematically illustrating a machine room of a cooking appliance according to another embodiment.
Figure 21:
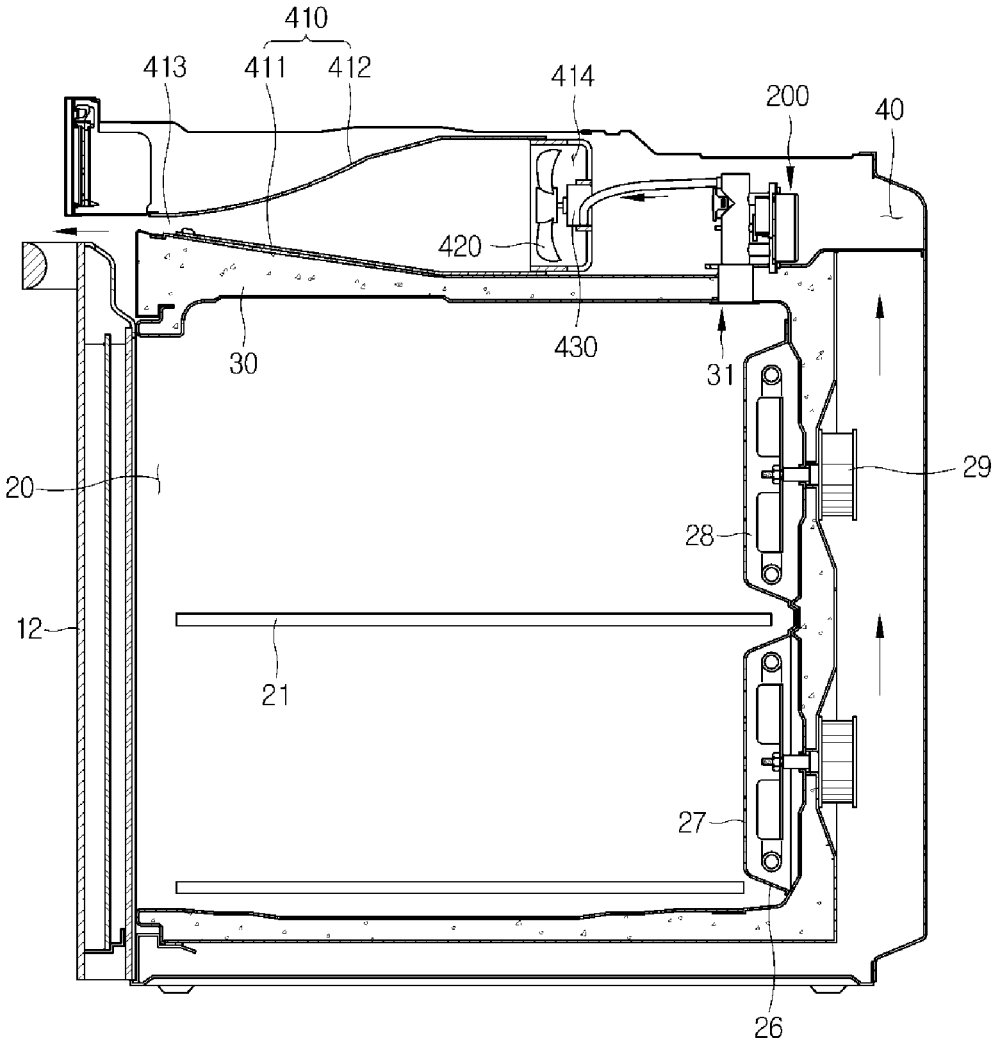
FIG. 21 is a schematic side view of the cooking appliance according to another embodiment.

FIG. 20 is a perspective view schematically illustrating a machine room of a cooking appliance according to another embodiment, and FIG. 21 is a schematic side view of the cooking appliance according to another embodiment. The same configuration as that in the cooking appliance of one embodiment has the same number, and a detailed description thereof will be omitted.

Referring to FIGS. 20 and 21, an exhaust assembly 400 and a sensor assembly 200 are provided at a machine room 40.

The exhaust assembly 400 includes an exhaust duct 410 which suctions fluids inside the machine room 40 and discharges the fluids to the front of the cooking appliance, an exhaust fan 420 which forcibly flow the fluids inside the machine room 40, and an exhaust motor 430 for driving the exhaust fan 420.

The exhaust duct 410 may be formed in a venturi tube shape in which a height becomes smaller and a cross section area is smaller toward the front of the cooking appliance. Thus, the velocity of fluids in the exhaust duct 410 becomes higher and a pressure thereof becomes lower toward the front of the cooking appliance 1.

Specifically, the exhaust duct 410 includes an upper duct 412 and a lower duct 411 which are coupled to upper and lower portions thereof and form an inner space through which fluids flow. The upper duct 412 and the lower duct 411 may be obliquely formed in a facing direction.

The upper duct 412 and the lower duct 411 are provided to have a height becoming smaller and a width becoming greater toward the front of the cooking appliance to generate the venturi effect in the inner space.

Exhaust ports 413 are formed in front surfaces of the upper duct 412 and the lower duct 411 through which fluids are discharged to the outside, and suction ports 414 are formed in rear surfaces of the upper duct 412 and the lower duct 411 through which fluids are introduced thereinto.

An exhaust fan 420 is provided behind the suction port 414. The exhaust fan 420 rotates in one direction, and fluids located behind the exhaust duct 410 flow forward. That is, the fluids inside the machine room 40 are suctioned into the suction port 414 by the exhaust fan 420. Like this, the fluids suctioned into the exhaust duct 410 by the exhaust fan 420 are discharged to the outside through the exhaust port 413 in the front of the exhaust duct 410.

The exhaust motor 430 is provided to generate a torque for driving the exhaust fan 420, and the exhaust fan 420 is rotated by the exhaust motor 430.

As described above, since the fluids inside the machine room 40 are forcibly discharged by the rotation of the exhaust fan 420, the machine room 40 is cooled.

Further, an atmospheric pressure around the exhaust fan 420 becomes lower than the surrounding atmospheric pressure by the rotation of the exhaust fan 420. Due to such a pressure difference, fluids inside the cooking chamber 20 flow along the sensor assembly 200. Further, the steam sensor of the sensor assembly 200 detects steam of fluids uniformly flowing along the transfer unit.

As described above, an amount of steam inside the cooking chamber 20 is measured using the fluids uniformly flown by a forced discharge of the exhaust fan 420, and thereby the amount of steam inside the cooking chamber 20 may be precisely measured.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cooking appliance comprising:

a cooking chamber in which food is accommodated;

a machine room separated from the cooking chamber;

an exhaust assembly configured to discharge fluids inside the machine room to outside; and a sensor assembly provided in the machine room and configured to measure an amount of steam of fluids which flow from the cooking chamber to the machine room by driving of the exhaust assembly, the sensor assembly including an inlet through which the fluids inside the cooking chamber are introduced and an outlet through which the introduced fluids are discharged, the outlet having a size smaller than a size of the inlet.

2. The cooking appliance of claim 1, wherein the sensor assembly includes:

a transfer unit in communication with the cooking chamber so that the fluids inside the cooking chamber flow into the machine room; and a sensor unit provided at the transfer unit and configured to detect an amount of steam of the fluids which flow along the transfer unit.

3. The cooking appliance of claim 2, wherein the sensor assembly further includes an exhaust pipe which guides the fluids introduced into the transfer unit to the exhaust assembly.

4. The cooking appliance of claim 2, wherein the sensor assembly further includes a blocking unit which blocks the fluids inside the cooking chamber from flowing into the machine room.

5. The cooking appliance of claim 4, wherein the blocking unit includes:

a throttle provided in the transfer unit and configured to block a flow path inside the transfer unit; and a valve motor configured to drive the throttle.

6. The cooking appliance of claim 5, wherein the blocking unit further includes:

a cam shaft coupled to the throttle and rotated by the valve motor; and a valve sensor which senses whether the flow path is blocked by a cam knob of the cam shaft.

7. The cooking appliance of claim 1, further comprising a control unit which determines a completion point of cooking of the food based on a change rate of the amount of steam.

8. The cooking appliance of claim 7, wherein the control unit calculates the change rate of the amount of steam according to a preset calculation period.

9. The cooking appliance of claim 7, wherein the control unit determines a cooking progress state of the food based on the change rate of the amount of steam, and determines the completion point of cooking based on the cooking progress state.

10. The cooking appliance of claim 9, wherein the control unit determines the cooking progress state of the food based on a maximum change rate of the amount of steam and a change rate of the amount of steam at a preset reference time.

11. The cooking appliance of claim 7, wherein the control unit determines the completion point of cooking of the food within a preset range of guide cooking time based on a type of the food.

12. The cooking appliance of claim 7, wherein the control unit performs an additional cooking process after the completion point of cooking so that the food is cooked in an input cooking state.

13. A cooking appliance comprising:

a cooking chamber in which food is accommodated;

a machine room provided separately from the cooking chamber;

an exhaust assembly configured to forcibly discharge fluids inside the machine room to outside; and a sensor assembly configured to measure an amount of steam of fluids which flow from the cooking chamber to the machine room by the forced discharge of the exhaust assembly, the sensor assembly including an inlet through which the fluids inside the cooking chamber are introduced and an outlet through which the introduced fluids are discharged, the outlet having a size smaller than a size of the inlet; and a control unit configured to determine a completion point of cooking of the food based on a change rate of the amount of steam measured by the sensor assembly.

14. The cooking appliance of claim 13, wherein the sensor assembly includes:

a transfer pipe in communication with the cooking chamber so that the fluids inside the cooking chamber are introduced into the transfer pipe;

an exhaust pipe connected to the transfer pipe so that the fluids introduced into the transfer pipe are guided to the exhaust assembly; and a steam sensor configured to protrude in an inward direction of the transfer pipe to measure an amount of steam of the fluids which flow in the transfer pipe.

15. The cooking appliance of claim 14, wherein the exhaust assembly includes:

an exhaust duct configured to guide air inside the machine room to the outside of the cooking appliance; and an exhaust fan configured to forcibly flow the air inside the machine room into the exhaust duct, wherein the exhaust pipe guides the fluids discharged from the outlet toward the exhaust fan.

16. The cooking appliance of claim 14, wherein the sensor assembly further includes:

a throttle provided in the transfer pipe and configured to block the fluids from being introduced into the cooking chamber; and a valve motor configured to drive the throttle, wherein the control unit determines whether the fluids being introduced are blocked based on whether automatic cooking of the cooking chamber is performed.

17. A method of controlling a cooking appliance including a cooking chamber, a machine room provided above the cooking chamber, an exhaust assembly configured to discharge fluids inside the machine room to outside, and a sensor assembly provided in the machine room and configured to measure an amount of steam of fluids which flow from the cooking chamber to the machine room by driving of the exhaust assembly, the sensor assembly including an inlet through which the fluids inside the cooking chamber are introduced and an outlet through which the introduced fluids are discharged, the method comprising:

driving the exhaust assembly;

measuring, by the sensor assembly, an amount of steam of fluids which flows from the inlet to the outlet;

calculating a change rate of the amount of steam the outlet having a size smaller than a size of the inlet; and determining a completion point of cooking of food based on the change rate of the amount of steam.

18. The method of claim 17, wherein the determining of the completion point of cooking includes:

determining a cooking progress state of the food based on a maximum change rate of the amount of steam and a change rate of the amount of steam at a reference time; and determining the completion point of cooking within a preset range of cooking guide time based on the cooking progress state.

19. The method of claim 18, further comprising additionally cooking the food according to a user input.

* * * * *